US005264331A

United States Patent [19]

Taniguchi et al.

[11] Patent Number: 5,264,331

[45] Date of Patent: Nov. 23, 1993

[54] COLOR DEVELOPING AGENT, PROCESSING LIQUID COMPOSITION AND PROCESS FOR FORMING COLOR IMAGE

[75] Inventors: Masato Taniguchi; Nobutaka Ohki; Koichi Nakamura, all of Minami-ashigara, Japan

[73] Assignee: Fuji Photo Film Co., Ltd., Minami-ashigara, Japan

[21] Appl. No.: 713,075

[22] Filed: Jun. 11, 1991

[30] Foreign Application Priority Data

Jun. 13, 1990 [JP] Japan ..... 2-154316

[51] Int. Cl.[5] ..... G03C 7/407

[52] U.S. Cl. ..... 430/442; 430/435; 430/464; 430/484; 546/226; 548/538; 564/47

[58] Field of Search ..... 564/47; 548/538; 546/226; 430/435, 440, 442, 446, 464, 480, 483, 484, 486, 490, 491, 492

[56] References Cited

U.S. PATENT DOCUMENTS 3,061,641 10/1962 Wright et al. ..... 564/47
4,008,272 2/1977 Kalopissis et al. ..... 564/47
4,629,467 12/1986 Clousen et al. ..... 564/47
5,006,439 4/1991 Wernicke et al. ..... 430/435

*Primary Examiner*—Hoa Van Le
*Attorney, Agent, or Firm*—Burns, Doane, Swecker & Mathis

[57] ABSTRACT

There are provided p-phenylenediamine color developing agent such as and which makes it possible to form a yellow dye having a color image fastness to light while its ordinary photographic properties such as the developing activity and hue are kept. A processing liquid composition for a silver halide color photosensitive material comprises the p-phenylenediamine color developing agent and a pH buffering agent, and has a pH of 9 to 12. A process for forming a color image of claim comprises color-developing an image-wise exposed silver halide color photographic material with the processing liquid composition at a temperature of 30° to 45° C. for 20 seconds to 4 minutes.

20 Claims, No Drawings

COLOR DEVELOPING AGENT, PROCESSING LIQUID COMPOSITION AND PROCESS FOR FORMING COLOR IMAGE

BACKGROUND OF THE INVENTION

The present invention relates to a new developing agent for a silver halide color photographic material, a liquid composition containing the developing agent for processing and a process for forming a color image with the processing liquid composition. In particular, the present invention relates to a developing agent for a silver halide color photographic material suitable for processing ordinary color photographs and having an improved light fastness of yellow dye, a processing liquid composition containing the developing agent and a process for forming a color image with the processing liquid.

Various p-phenylenediamine compounds, particularly N,N-dialkyl-substituted p-phenylenediamine compounds, were proposed as color developing agents to be contained in a color developer. For example, alkyl groups at N-position proposed heretofore include N-hydroxyalkyl groups described in U.S. Pat. No. 2,108,243 and British Patent No. 807,899, N-sulfonamidoalkyl groups described in U.S. Pat. Nos. 2,193,015, 2,552,240 and 2,566,271, N-sulfamoylalkyl groups described in U.S. Pat. No. 2,193,015, N-acylaminoalkyl groups described in U.S. Pat. Nos. 2,552,242 and 2,592,363, N-quaternary ammoniumalkyl groups described in British Patent No. 539,937, N-alkyl groups having a phosphorus atom as their substituent described in British Patent No. 539,395, N-acylalkyl groups described in U.S. Pat. No. 2,374,337, N-alkoxyalkyl groups described in U.S. Pat. No. 2,603,656, Japanese Patent Unexamined Published Application (hereinafter referred to as "J. P. KOKAI") Nos. Sho 47-11534 and Sho 47-11535, Japanese Patent Publication for Opposition Purpose (hereinafter referred to as "J. P. KOKOKU") Nos. Sho 54-16860, Sho 58-14670 and Sho 58-23618, N-sulfoalkyl groups described in British Patent No. 811,679 and N-aralkyl groups described in U.S. Pat. No. 2,716,132. The substituents of the benzene nucleus include, for example, nuclear alkoxyl groups described in U.S. Pat. Nos. 2,304,953, 2,548,574, 2,552,240 and 2,592,364, nuclear acylaminosulfonamide groups described in U.S. Pat. Nos. 2,350,109 and 2,449,919, nuclear acylaminoalkylsulfonamidoalkyl groups described in U.S. Pat. Nos. 2,552,241, 2,556,271 and 2,592,364, nuclear amino group described in U.S. Pat. Nos. 2,570,116, 2,575,027 and 2,652,331, and nuclear thiosulfonic acid groups described in British Patent No. 872,683. As for the use of compounds analogous to p-phenylenediamine as the color developing agents, tetrahydroquinolines and dihydroindoles are described in U.S. Pat. Nos. 2,196,739 and 2,566,259, N-(p-aminophenyl)hexamethyleneimines are described in U.S. Pat. No. 2,612,500 and 9-aminodurolidines are described in U.S. Pat. No. 2,707,681.

Among various photographic properties required of color developing agents, three properties that the developing activity is high, that hue of the dye formed by the coloring reaction with a coupler is suitable for the color reproduction and that the dye is stable to heat and light are indispensable. However, it is a difficult technical problem to satisfy all of the three requirements by improving the color developing agent. Investigations have been made in this technical field on the improvement of the developing activity by improving mainly the silver halide emulsion and improvement of the hue and fastness of the resulting dye by improving the coupler and using a fading inhibitor.

SUMMARY OF THE INVENTION

The present invention has been completed under these circumstances.

A primary object of the present invention is to provide a color developing agent capable of forming a yellow dye having a color image fastness to light and a cyan dye having a color image fastness to wet heat while its ordinary photographic properties such as the developing activity and hue are kept.

Another object of the present invention is to provide a liquid for processing silver halide color photosensitive materials which liquid contains this developing agent and a process for forming a color image.

These and other objects of the present invention will be apparent from the following description and Examples.

The above-described problems were solved by a p-phenylenediamine developing agent for color photographic material characterized in that one of the amino groups is a primary amino group and the other is a tertiary amino group substituted with a group of the following general formula [I]:

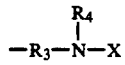

a processing liquid composition for a silver halide color photographic material characterized by containing at least one of the developing agents, and a process for forming a color image characterized by developing the silver halide color photographic material with a processing liquid containing at least one of the developing agents.

The developing agents are preferably those of the following general formula [II]:

general formula [II]:

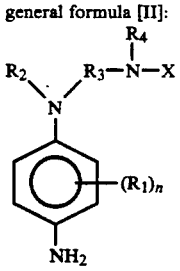

wherein $R_1$ represents a substituent, n represents an integer of 0 to 4 and when n is 2 or more, $R_1$'s may be the same or different from each other, $R_2$ represents an alkyl group, $R_3$ represents an alkylene group wherein the main chain has at least 2 carbon atoms, $R_4$ represents a hydrogen atom or an alkyl group, and X represents a group selected from among:

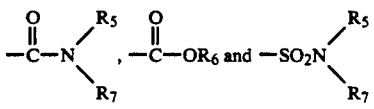

in which $R_5$ and $R_7$ may be the same or different from each other, each represent a hydrogen atom, an alkyl group or an aryl group and may form a heterocyclic ring by the combination thereof, and $R_6$ represents an alkyl group or an aryl group.

DESCRIPTION OF THE PREFERRED EMBODIMENTS

The detailed description will be made on $R_1$, $R_2$, $R_3$, $R_4$, $R_5$, $R_6$, $R_7$. X and n in the above general formulae [I] and [II] for the compounds used in the present invention.

$R_1$ represents a substituent. In particular, $R_1$ represents a halogen atom or an alkyl group, aryl group, heterocyclic group, cyano group, nitro group, hydroxyl group, carboxyl group, alkoxyl group, aryloxy group, acylamino group, alkylamino group, anilino group, ureido group, sulfamoylamino group, alkylthio group, arylthio group, alkoxycarbonylamino group, sulfonamide group, carbamoyl group, sulfamoyl group, sulfonyl group, alkoxycarbonyl group, heterocyclic oxy group, azo group, acyloxy group, carbamoyloxy group, silyl group, silyloxy group, aryloxycarbonylamino group, imide group, heterocyclic thio group, sulfinyl group, phosphonyl group, aryloxycarbonyl group or acyl group.

In particular, $R_1$ represents a halogen atom (such as fluorine or chlorine atom), an alkyl group (a straight, branched or cyclic alkyl group having 1 to 16 carbon atoms which may be substituted with an alkenyl, alkynyl, hydroxyl, nitro or cyano group, with a halogen atom or a substituent connected therewith through an oxygen, nitrogen or sulfur atom or through a carbonyl group, for example, methyl, ethyl, propyl, isopropyl, t-butyl, 2-hydroxyethyl, 3-hydroxypropyl, 2-methanesulfonamidoethyl, 3-methanesulfonamidopropyl, 2-methanesulfonylethyl, 2-methoxyethyl, cyclopentyl, 2-acetamidoethyl, 2-carboxylethyl, 2-carbamoylethyl, 3-carbamoylpropyl, n-hexyl, 2-hydroxypropyl, 4-hydroxybutyl, 2-carbamoylaminoethyl, 3-carbamoyl-1-methylethyl or 4-nitrobutyl group), an aryl group having 6 to 24 carbon atoms (such as phenyl, naphthyl or p-methoxyphenyl group), a heterocyclic group of 5 or 6 membered ring having 1 to 5 carbon atoms and at least one atom selected from the group consisting of oxygen, nitrogen and sulfur (such as 2-furyl, 2-thienyl, 2-pyrimidinyl, 2-benzotriazolyl, imidazolyl or pyrazolyl group), cyano group, nitro group, hydroxyl group, carboxyl group, an alkoxyl group having 1 to 16 carbon atoms (such as methoxy, ethoxy, 2-methoxyethoxy or 2-methanesulfonylethoxy group), an aryloxy group having 6 to 24 carbon atoms (such as phenoxy group), an acylamino group having 1 to 16 carbon atoms (such as acetamide or 2-methoxypropionamide group), an alkylamino group having 1 to 16 carbon atoms (such as dimethylamino or diethylamino group), an anilino group having 6 to 24 carbon atoms (such as anilino or m-nitroanilino group), ureido group having 1 to 16 carbon atoms (such as methylureido or N,N-diethylureido group), sulfamoylamino group having 0 to 16 carbon atoms (such as di-methylsulfamoylamino group), an alkylthio group having 1 to 16 carbon atoms (such as methylthio or ethylthio group), an arylthio group having 6 to 24 carbon atoms (such as phenylthio group), an alkoxycarbonylamino group having 2 to 16 carbon atoms (such as methoxycarbonylamino or ethoxycarbonylamino group), a sulfonamide group having 1 to 16 carbon atoms (such as methanesulfonamide group), a carbamoyl group having 1 to 16 carbon atoms (such as N,N-dimethylcarbamoyl or N-ethylcarbamoyl group), a sulfamoyl group having 0 to 16 carbon atoms (such as dimethylsulfamoyl group), a sulfonyl group having 1 to 16 carbon atoms (such as methanesulfonyl or ethanesulfonyl group), an alkoxycarbonyl group having 1 to 16 carbon atoms (such as methoxycarbonyl or ethoxycarbonyl group), a heterocyclic oxy group of 5 or 6 membered ring having 1 to 5 carbon atoms and at least one atom selected from the group consisting of oxygen, nitrogen and sulfur (such as 1-phenyltetrazolyl-5-oxy or 2-tetrahydropyranyloxy group), an azo group having 1 to 16 carbon atoms (such as phenylazo or 2-hydroxy-4-propanoylphenylazo groups), an acyloxy group having 1 to 16 carbon atoms (such as acetoxy group), a carbamoyloxy group having 1 to 16 carbon atoms (such as N,N-dimethylcarbamoyloxy group), a silyl group having 3 to 16 carbon atoms (such as trimethylsilyl group), a silyloxy group having 3 to 16 carbon atoms (such as trimethylsilyloxy group), an aryloxycarbonylamino group having 7 to 24 carbon atoms (such as phenoxycarbonylamino group), an imide group having 4 to 16 carbon atoms (such as N-succinimide group), a heterocyclic thio group of 5 or 6 membered ring having 1 to 5 carbon atoms and at least one atom selected from the group consisting of oxygen, nitrogen and sulfur (such as 2-benzothiazolylthio or 2-pyridylthio group), a sulfinyl group having 1 to 16 carbon atoms (such as ethanesulfinyl group), a phosphonyl group having 2 to 16 carbon atoms (such as methoxyphosphonyl group), an aryloxycarbonyl group having 7 to 24 carbon atoms (such as phenoxycarbonyl group) or an acyl group having 1 to 16 carbon atoms (such as acetyl or benzoyl group).

Among these substituents, preferred $R_1$ is an alkyl group, alkoxyl group, alkoxycarbonylamino group or ureido group, particularly an alkyl group and more particularly a methyl or ethyl group.

n represents an integer of 0 to 4. When n is 2 or more, $R_1$'s may be the same or different from each other. n is preferably 0 or 1. n is still preferably 1.

$R_2$ is an alkyl group. In particular, $R_2$ is an alkyl group (a straight, branched or cyclic alkyl group having 1 to 16 carbon atoms which may be substituted with an alkenyl, alkynyl, aryl, hydroxyl, nitro or cyano group, with a halogen atom or a substituent connected therewith through an oxygen, nitrogen or sulfur atom or through a carbon atom such as methyl, ethyl, propyl, isopropyl, t-butyl, 2-hydroxyethyl, 3-hydroxypropyl, benzyl, 2-methanesulfonamidoethyl, 3-methanesulfonamidopropyl, 2-methanesulfonylethyl, 2-methoxyethyl, cyclopentyl, 2-acetamidoethyl, 2-carboxylethyl, 2-carbamoylethyl, 3-carbamoylpropyl, n-hexyl, 2-hydroxypropyl, 4-hydroxybutyl, benzyl, 2-carbamoylaminoethyl, 3-carbamoylaminopropyl, 4-carbamoylaminobutyl, 4-carbamoylbutyl, 2-carbamoyl-1-methylethyl or 4-nitrobutyl group).

Among these substituents, preferred R, is a methyl, ethyl, propyl, isopropyl, t-butyl, 2-hydroxyethyl, 3-hydroxypropyl, 2-methoxyethyl, 2-methanesulfonamidoethyl or 2-acetamidoethyl group, more preferably a methyl, ethyl, propyl, isopropyl or t-butyl group, particularly a methyl, ethyl or propyl, and most preferably ethyl or propyl.

$R_3$ is an alkylene group. In particular, $R_3$ is an alkylene group wherein the main chain has at least 2 carbon atoms (a straight or branched alkylene group which may be substituted with a hydroxyl, nitro or cyano group, with a halogen atom or with a substituent connected therewith through an oxygen, nitrogen or sulfur atom or through a carbon atom such as ethylene, 2-methylethylene, 2-fluorotrimethylene, trimethylene, tetramethylene, pentamethylene, hexamethylene, 2-methyltrimethylene, 2-methoxytrimethylene, 1-methyltetraene or 1-methylethylene group). Among these, ethylene, trimethylene and tetramethylene are preferable.

Among these substituents, preferred R, is ethylene, 2-methylethylene, propylene, tetramethylene, 2-methylpropylene or 1-methylethylene group.

$R_4$ represents a hydrogen atom or an alkyl group. In particular, $R_4$ represents a hydrogen atom or an alkyl group [a straight chain or branched alkyl group having 1 to 16 carbon atoms which may be substituted with an alkenyl, alkynyl, aryl, hydroxyl, nitro, carboxyl or cyano group, with a halogen atom or with a substituent connected therewith through an oxygen, nitrogen or sulfur atom or through a carbon atom such as methyl, ethyl, propyl, isopropyl, t-butyl, 2-hydroxyethyl, 2-carboxyethyl, 3-sulfopropyl, isopropyl or 3-(N,N-dimethyl)aminopropyl group].

Among them, preferred $R_4$ is hydrogen atom, or methyl or ethyl group. Hydrogen atom is particularly preferred.

X is a group selected from among:

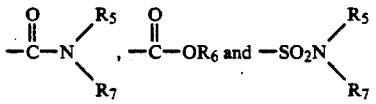

X is particularly preferably a group of the formula:

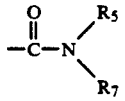

$R_5$ and $R_7$ each represent a hydrogen atom, an alkyl group aryl group. In particular, $R_5$ and $R_7$ each represent a hydrogen atom, an alkyl group [a straight chain or branched alkyl group having 1 to 16 carbon atoms which may be substituted with an alkenyl, alkynyl, aryl, hydroxyl, nitro, carboxyl or cyano group, with a halogen atom or with a substituent connected therewith through an oxygen, nitrogen or sulfur atom or through a carbon atom such as methyl, ethyl, propyl, t-butyl, 2-hydroxyethyl, 2-carboxyethyl, 3-sulfopropyl, isopropyl or 3-(N,N-dimethyl)aminopropyl group] or an aryl group (having 6 to 24 carbon atoms such as a phenyl, naphthyl or p-methoxyphenyl group).

$R_5$ and $R_7$ may form a heterocyclic ring by the combination thereof. In this respect, it is preferable to form a heterocyclic ring of 5 or 6 membered ring containing a nitrogen atom to which $R_5$ and $R_7$ are bonded. Examples of the heterocyclic rings include pyrrolidino, piperazino, morpholino and 3-hydroxypyrrolidino.

Among them, preferred $R_5$ is a hydrogen atom or an alkyl group. Hydrogen atom is particularly preferred.

When X is —CO—$NR_5R_7$, $R_7$ is preferably a hydrogen atom or an alkyl group (particularly preferably hydrogen atom) and when X is $SO_2R_6R_7$, $R_7$ is preferably an alkyl group or aryl group (still preferably an alkyl group, particularly methyl or ethyl group).

$R_6$ is an alkyl group or aryl group. In particular, $R_6$ represents an alkyl group [a straight chain or branched alkyl group having 1 to 16 carbon atoms which may be substituted with a hydroxyl, nitro, carboxyl or cyano group, with a halogen atom or with a substituent connected therewith through an oxygen, nitrogen or sulfur atom or through a carbon atom such as methyl, ethyl, propyl, t-butyl, 2-hydroxyethyl, 2-carboxyethyl, 3-sulfopropyl, isopropyl or 3-(N,N-dimethyl)aminopropyl group] or an aryl group (having 6 to 24 carbon atoms such as a phenyl, naphthyl or p-methoxyphenyl group).

Among them, preferred $R_6$ is an alkyl group, particularly methyl or ethyl group.

In the compounds represented by the general formula [II], particularly preferred are those of the following general formula [III]:

general formula [III]:

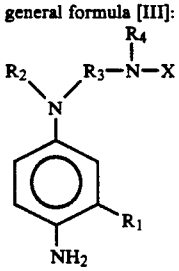

wherein $R_1$, $R_2$, $R_3$, $R_4$ and X are as defined above.

Since the compound of the general formula [1] is quite unstable when it is stored in the free amine form, it is preferably produced and stored in the form of its salt with an inorganic acid or organic acid an is converted into the free amine when it is to be added to the processing liquid. Examples of the inorganic or organic acids for forming the salt of the compound of the general formula [I] include hydrochloric acid, sulfuric acid, phosphoric acid, p-toluenesulfonic acid, methanesulfonic acid and naphthalene-1,5-disulfonic acid.

Typical examples of the developing agents of the present invention will be given below, which by no means limit the developing agents of the invention:

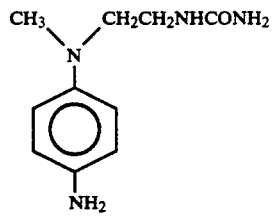

(1)

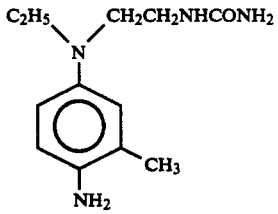

(2)

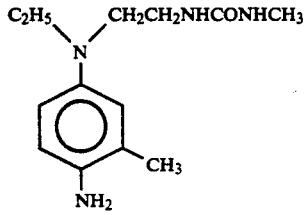

(3)

-continued
(4)
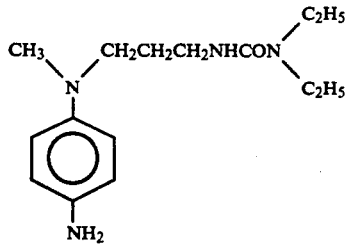
(5)
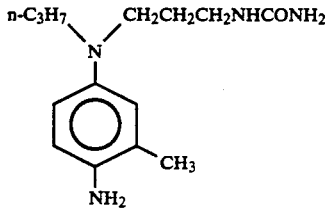
(6)
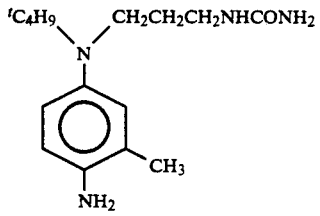
(7)
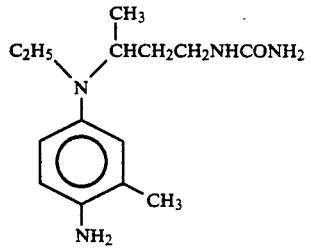
(8)
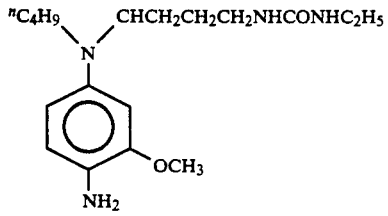
(9)
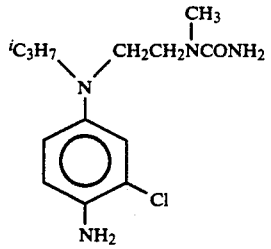
(10)
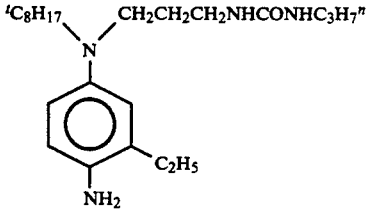
-continued
(11)
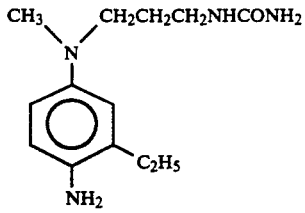
(12)
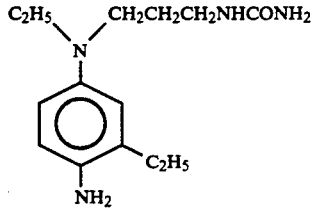
(13)
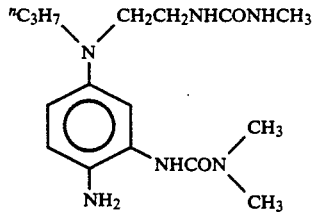
(14)
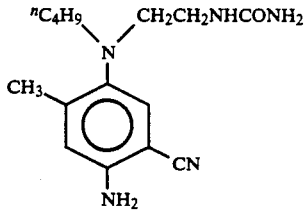
(15)
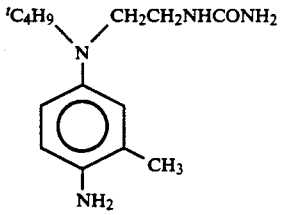
(16)
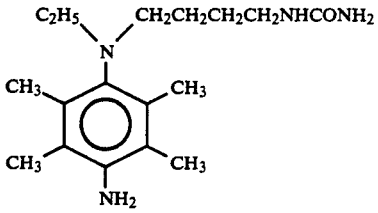
(17)
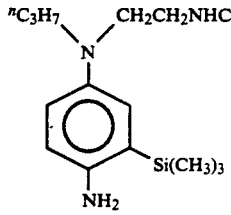

-continued
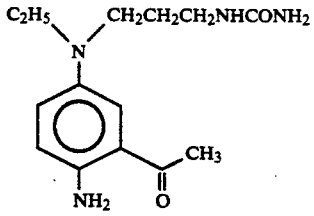
(18)
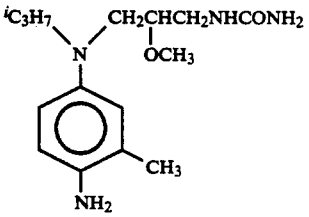
(19)
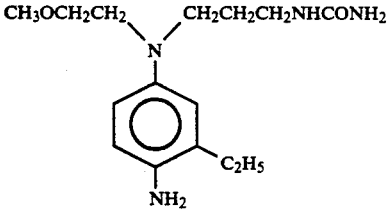
(20)
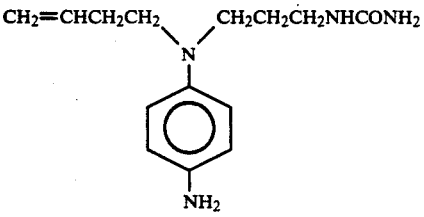
(21)
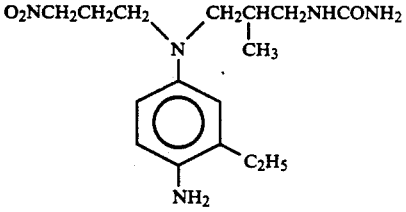
(22)
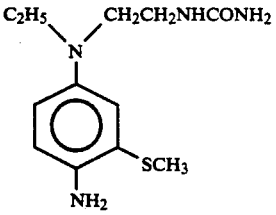
(23)
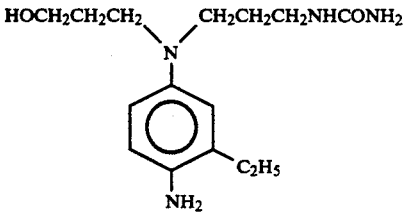
(24)
-continued
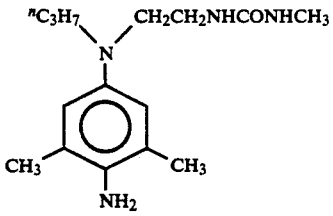
(25)
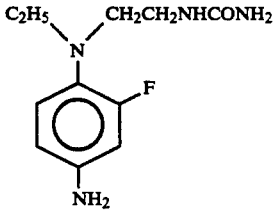
(26)
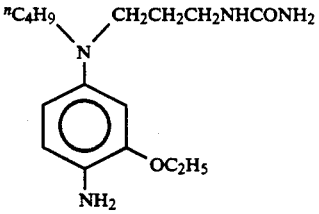
(27)
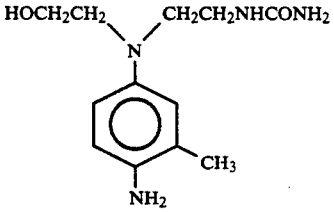
(28)
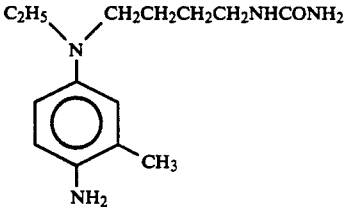
(29)
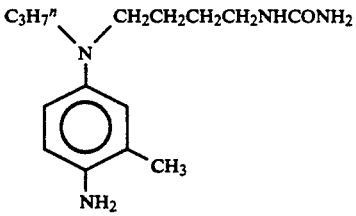
(30)
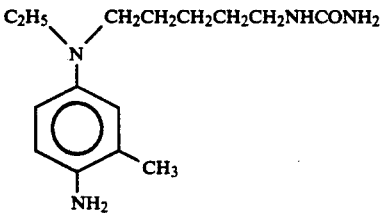
(31)

-continued
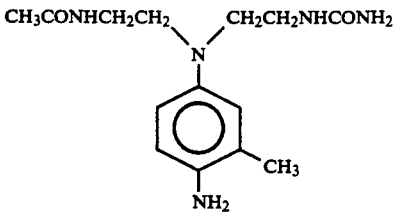
(32)
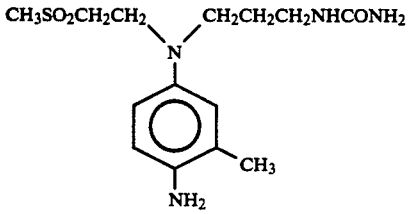
(33)
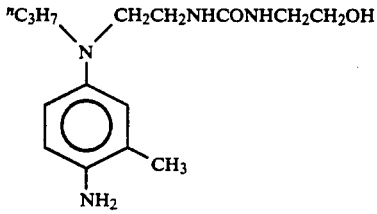
(34)
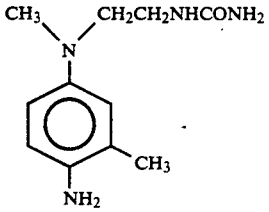
(35)
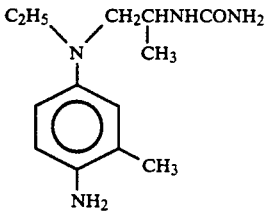
(36)
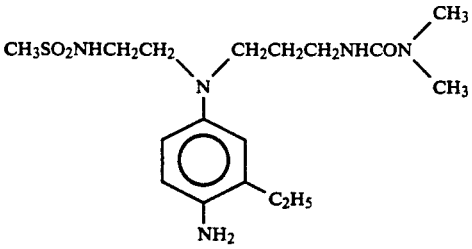
(37)
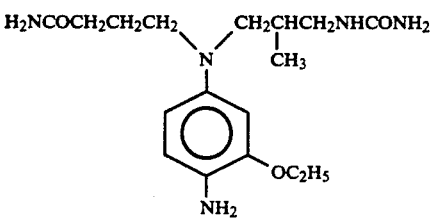
(38)
-continued
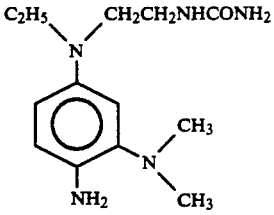
(39)
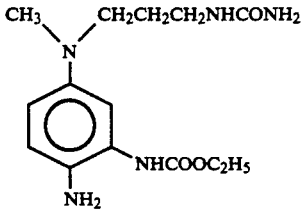
(40)
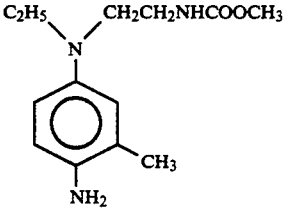
(41)
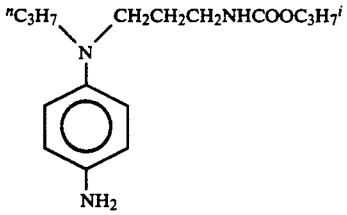
(42)
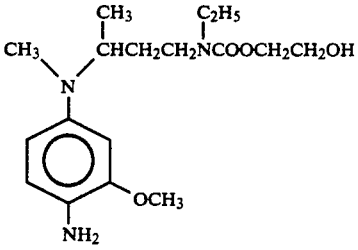
(43)
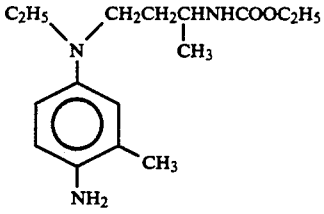
(44)
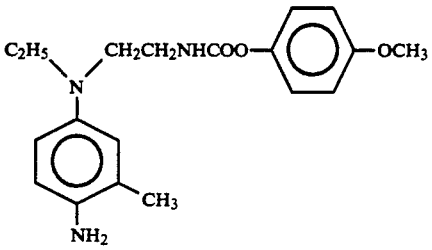
(45)

-continued
(46)
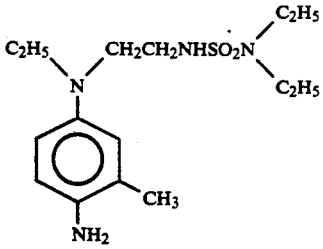
(47)
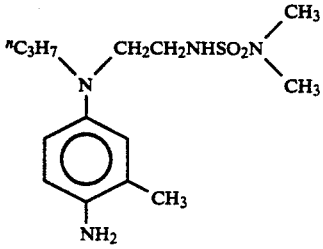
(48)
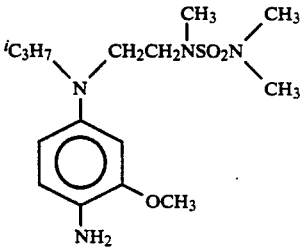
(49)
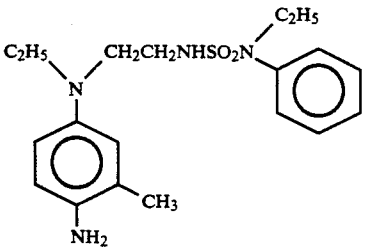
(50)
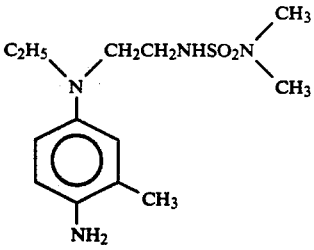
(51)
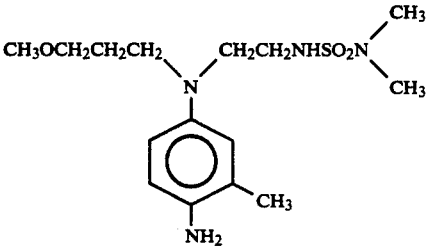
-continued
(52)
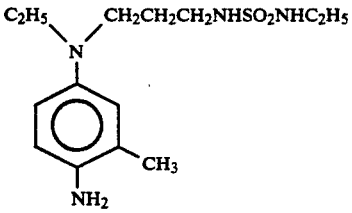
(53)
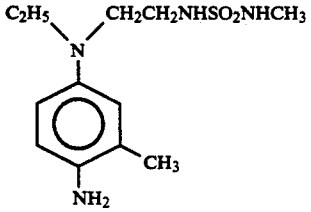
(54)
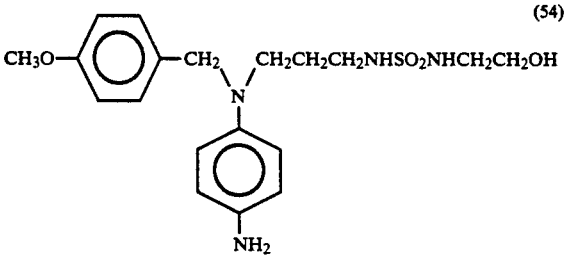
(55)
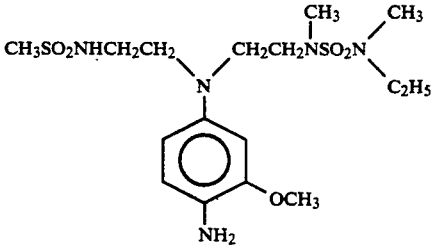
(56)
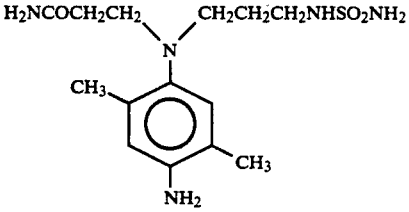
(57)
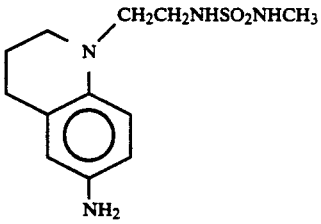
(58)
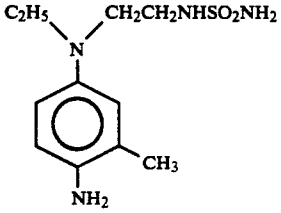

-continued (59)

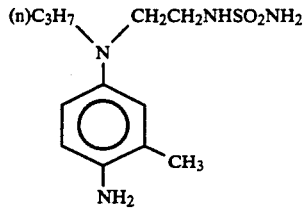

(60)

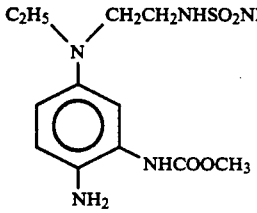

(61)

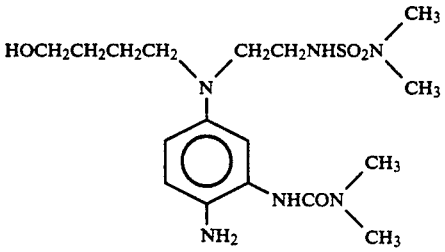

(62)

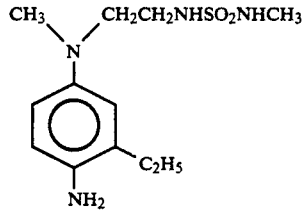

(63)

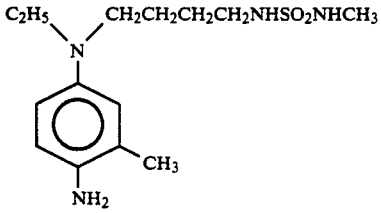

(64)

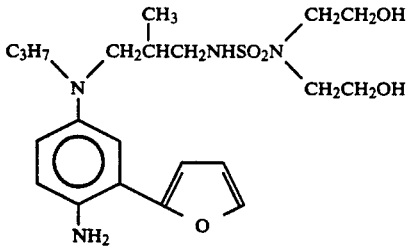

(65)

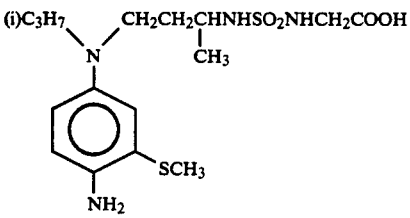

-continued (66)

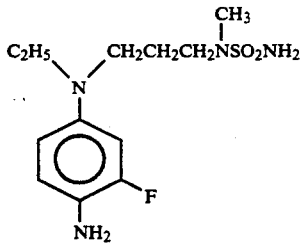

(67)

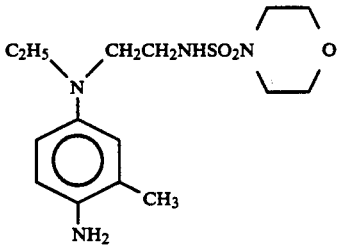

The description will be made on an ordinary process for producing the developing agents of the present invention. They can be synthesized by, for example, a process described in Journal of the American Chemical Society, Vol. 73, p. 3100.

SYNTHESIS EXAMPLE 1

Compound (5) of the present invention listed above was synthesized according to the following formulae:

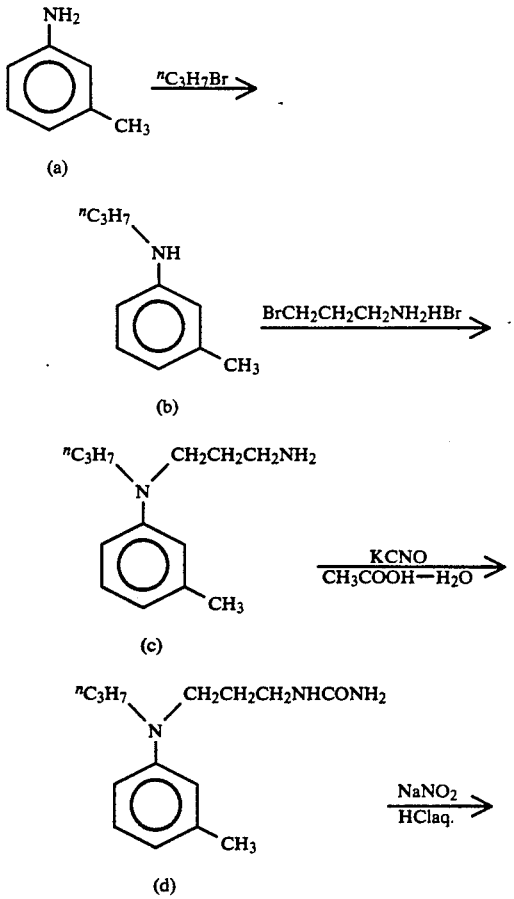

-continued

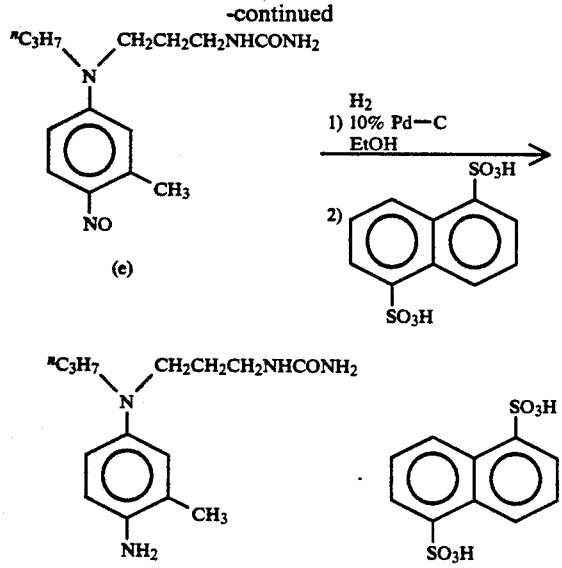

SYNTHESIS OF COMPOUND (b)

267 ml (2.85 mol) of n-propyl bromide was added to 305 g (2.85 mol) of Compound (a) and they were stirred at room temperature for 10 h. In the course of the stirring, the reaction liquid gradually became viscous and was finally solidified. Then 250 g of sodium hydrogencarbonate and 1l of water were added thereto. After extraction with ethyl acetate (1 1×1) followed by drying over Glauber's salt and distillation of ethyl acetate under reduced pressure, an oil containing Compound (b) was obtained, which was purified according to silica gel column chromatography to obtain 200 g of Compound (b) (yield: 47%)

SYNTHESIS OF COMPOUND (C)

88.0 g ($4.02\times10^{-1}$ mol) of 3-bromopropylamine hydrobromide was added to 50.0 g ($3.35\times10^{-1}$ mol) of Compound (b) and they were stirred at 120° C. in an oil bath for 2 h. In the course of the stirring, the reaction liquid was gradually solidified. 40 g of sodium hydrogencarbonate and 500 ml of water were added thereto. After extraction with ethyl acetate (500 m 1×1) followed by drying over Glauber's salt and distillation of ethyl acetate under reduced pressure, 71.0 g of an oil containing Compound (c) was obtained.

SYNTHESIS OF COMPOUND (D)

50 ml of acetic acid and 40 ml of water were added to 54.8 ($2.85\times10^{-1}$ mol) of Compound (c). Then 40 g $4.93\times10^{-1}$ mol) of potassium cyanate was added thereto under stirring at room temperature and the stirring was continued for 1 h. 500 ml of water was added thereto. After extraction with ethyl acetate (500 ml×1) followed by drying over Glauber's salt and distillation of ethyl acetate under reduced pressure, an oil containing Compound (d) was obtained. It was purified according to silica gel column chromatography and recrystallized from acetonitrile to obtain 31.8 g of Compound (d) (yield: 47%).

SYNTHESIS OF COMPOUND (E)

23.4 ml ($2.27\times10^{-1}$ mol) of 12 N hydrochloric acid and 103 m l of water were added to 25.7 g ($1.03\times10^{-1}$ mol) of Compound (d). A solution of 7.12 g ($1.03\times10^{-1}$ mol) of sodium nitrite in 10 ml of water was added dropwise thereto under stirring and under cooling with ice. Then the stirring was continued for 45 min. Thereafter 20 g of sodium hyrogencarbonate was added thereto. After extraction with an ethyl acetate / acetonitrile solvent mixture followed by drying over Glauber's salt and distillation off of ethyl acetate and acetonitrile under reduced pressure, an oil containing Compound (e) was obtained. It was purified according to silica gel column chromatography to obtain 23.0 g of Compound (e) (yield: 85%).

SYNTHESIS OF COMPOUND 5

About 2 g of 10% palladium carbon was added to a solution of 23. 0 g ($8.27\times10^{-2}$ mol) of Compound (d) in 200 ml of ethanol. They were brought into contact with hydrogen gas under stirring at room temperature. Then the catalyst was filtered off through Celite. The filtrate was added dropwise to a solution of 29.8 g ($8.27\times10^{-2}$ mol) of 1,5-dinaphthalenesulfonic acid (tetrahydrate) in 200 ml of ethanol. Crystals thus precipitated were taken by filtration. 18.8 g of intended Compound 5 (in the form of a salt with 1,5-dinaphthalenesulfonic acid) was obtained as light pink crystals. The properties of the product were as follows:

Melting point: Gradual decomposition started at 230° C. to form a red melt.

$^1$H-NMR (DMSO-$d_6$): $\delta$=0.85 (t, 3H), 1.06 (t, 3H), 1.3 to 1.6 (m, 4H), 2,24 (s, 3H), 2.9 to 3.1 (m, 2H), 3.2 to 3.5 (m, 6H), 5.8 to 7.0 (brs, 6H), 7.0 to 7.2 (m, 3H), 7.46 (t, 2H), 7.96 (d, 2H), 8.87 (d, 2H).

It will be apparent from $^1$H-NMR that Compound (5) was obtained in the form of crystals containing ethanol in a molar ratio of 1:1.

SYNTHESIS EXAMPLE 2

Compound (2) of the present invention listed above was synthesized in the same manner as in Synthesis Example 1 except that the following compound (f) was used instead of compound (c) and obtained in the form of a salt with 1,5-dinaphthalenesulfonic acid.

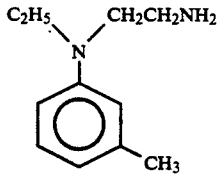

(f)

The properties of the product were as follows:

Melting point: 255°~266° C. (decomposed in red). $^1$H-NMR (DMSO-$d_6$): $\delta$=0.98 (t, 3H), 2.25 (s, 3H), 3.0 to 3.2 (m, 2H), 3.3 to 3.6 (m, 4H), 6.9 to 7.1 (m), 7.20 (d), 7.42 (d), 7.48 (d), 6.7 to 7.9 (br, 10H:total of this signal and aforementioned four signals), 7.97 (d, 2H), 8.87 (d, 2H).

SYNTHESIS EXAMPLE 3

Synthesis of Compound (50) of the present invention listed above

Compound (9) was prepared as follows: d

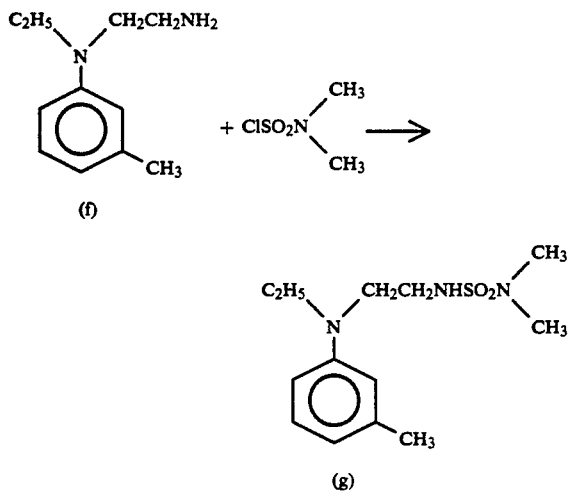

25.4 ml ($2.37\times10^{-1}$ mol) of $(CH_3)_2NSO_2Cl$ and subsequently 33.0 ml ($2.37\times10^{-1}$ mol) of trimethylamine were added dropwise to 169 ml of acetonitrile solution containing 42.2 g ($2.37\times10^{-1}$ mol) of compound (f) under stirring and cooling with ice, and the resultant was stirred for 2 hours at a room temperature. Then 500 ml of ethyl acetate was added thereto, washed with water and saturated sodium chloride aqueous solution, dried with Glauber's salt. Ethyl acetate was distilled off under a reduced condition and then 62.0 g of oil containing compound (g) was obtained.

Compound (50) of the present invention listed above was synthesized in the same manner as in Synthesis Example 1 except that the compound (g) was used instead of compound (d) and obtained in the form of a salt with 1,5-dinaphthalenesulfonic acid. The properties of the product were as follows:

Melting point: 205°~208° C. (decomposed in red).

$^1$H-NMR (DMSO-$d_6$): $\delta=1.04$ (t, 3H), 2.23 (s, 3H), 2.66 (s, 6H),2.9 to 3.1 (m, 2H), 3.3 to 3.5 (m, 4H), 6.7 to 6.9 (m, 2H), 7.16 (d, 1H), 7.42 (d, 1H), 7.48 (d, 1H), 7.97 (d, 2H), 8.88 (d, 2H).

SYNTHESIS EXAMPLE 4

Synthesis of Compound (53) of the present invention listed above

Compound (i) was prepared as follows:

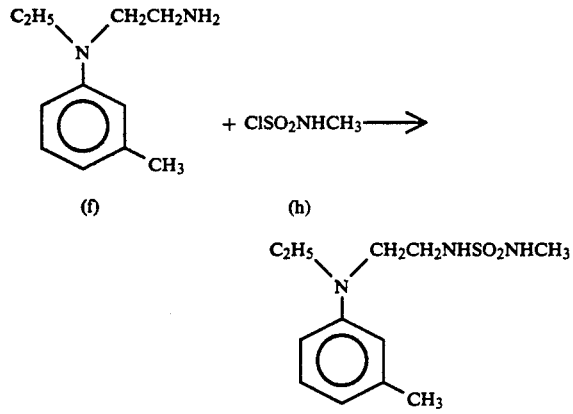

56.4 g ($4.35\times10^{-1}$ mol) of compound (h)[prepared by the method set out in Liebigs Annalen Chemie vol. 729. page 40(1969)] and subsequently 60.7 ml ($4.35\times10^{-1}$ mol) of trimethylamine were added dropwise to 380 ml of acetonitrile solution containing 76.7 g ($4.35\times10^{-1}$ mol) of compound (f) under stirring and cooling with ice, and the resultant was stirred for 2 hours at a room temperature. Then 1000 ml of ethyl acetate was added thereto, washed with water and saturated sodium chloride aqueous solution, dried with Glauber's salt. Ethyl acetate was distilled off under a reduced condition and then 107 g of oil containing compound (i) was obtained. The thus prepared oil was purified by silica gel chromatography to obtain 43.0 g of compound (i) [yield 37%].

Compound (53) of the present invention listed above was synthesized in the same manner as in Synthesis Example 1 except that the compound (i) was used instead of compound (d) and obtained in the form of a salt with 1,5-dinaphthalenesulfonic acid. The properties of the product were as follows:

Melting point: 208°~212° C. (decomposed in melt).

$^1$H-NMR (DMSO-$d_6$): $\delta=0.9$ to 1.1 (m, 6H), 2.27 (s, 3H), 2.42 (s, 3H), 2.8 to 3.0 (m, 2H), 3.3 to 3.5 (m, 6H), 6.6 to 6.8 (m, 2H), 7.12 (d, 1H), 7.40 (d, 1H), 7.45 (d, 1H), 7.96 (d, 2H), 8.88 (d, 2H).

It will be apparent from $^1$H-NMR that Compound (53) was obtained in the form of crystals containing ethanol in a molar ratio of 1:1.

The processing liquid used in the present invention contains at least one developing agent for silver halide color photographic material according to the present invention. It is preferably an alkaline aqueous solution containing the developing agent as the main ingredient. The developing agent of the present invention can be used solely or in combination with a known black-and-white developing agent such as an aromatic primary amine color developing agent, dihydroxybenzene (e.g. hydroquinone), 3-pyrazolidone (e.g. 1-phenyl-3-pyrazolidone) or aminophenol (e.g. N-methyl-p-aminophenol). The developing agent of the present invention is used in an amount of $2\times10^{-4}$ to $1\times10^{-1}$ mol, preferably $1\times10^{-3}$ mol to $5\times10^{-2}$ mol, per liter of the processing liquid.

The color developer of the present invention usually contains a pH buffering agent such as an alkali metal carbonate, borate or phosphate; a development restrainer such as a bromide, iodide, benzimidazole, benzothiazole or mercapto compound; or a fog inhibitor. If necessary, the color developer may further contain preservatives such as hydroxylamine, diethylhydroxylamine, sulfites, hydrazines, phenylsemicarbazides, triethanolamine, catecholsulfonic acids and triethylenediamine(1,4-diazabicyclo[2,2,2]octane) compounds; organic solvents such as ethylene glycol and diethylene glycol; development accelerators such as benzyl alcohol, polyethylene glycol, quaternary ammonium salts and amines; dye-forming couplers; competing couplers; fogging agents such as sodium boron hydride; assistant developing agents such as 1-phenyl-3-pyrazolidone; thickening agents; chelating agents such as aminopolycarboxylic acids, aminopolyphosphonic acids, alkylphosphonic acids and phosphonocarboxylic acids, e.g. ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di-(o-hydroxyphenylacetic acid) and salts of them.

When a reversal process is employed, usually black-and-white development is conducted and then color development is conducted. The black-and-white developer comprises one or a combination of two or more known black-and-white developing agents such as dihydroxybenzenes, e.g. hydroquinone, 3-pyrazolidones, e.g. 1-phenyl-3-pyrazolidone and aminophenols, e.g. N-methyl-p-aminophenol.

The pH of these color developers or black-and-white developers is usually 9 to 12, preferably 10 to 12. In this connection, it is preferable that the color developing be conducted at a temperature of 30° to 45° C. for 20 seconds to 4 minutes. The amount of the developer to be replenished varies depending on the color photosensitive material to be processed. It is usually not larger than 3 l per $m^2$ of the photosensitive material. When bromide ion concentration in the replenisher is reduced, the amount of the replenisher can be reduced to 500 ml or less. When the amount of the replenisher is reduced, the evaporation of the liquid and oxidation thereof with air are preferably inhibited by reducing the contact area of the processing vessel with air. The amount of the replenisher can be reduced also by inhibiting accumulation of bromide ion in the developer.

After completion of the color development, the photographic emulsion layer is usually bleached. The bleaching process can be conducted simultaneously with the fixing process (bleach-fixing process) or separately from it. For acceleration, the bleach-fixing process may be conducted after the bleaching process. Depending on the purpose, two bleach-fixing vessels connected with each other can be employed; the fixing process can be conducted prior to the bleach-fixing process; or the bleaching process can be conducted after the bleach-fixing process. Examples of the bleaching agents include compounds of polyvalent metals such as iron (III), cobalt (III), chromium (Iv) and copper (II); peracids, quinones and nitro compounds. Typical examples of the bleaching agents include ferricyanides; bichromates; organic complex salts or iron (III) or cobalt (III) such as aminopolycarboxylates, e.g. ethylenediaminetetraacetate, diethylenetriaminepentaacetate, cyclohexanediaminetetraacetate, methyliminodiacetate, 1,3-diaminopropanetetraacetate and glycol ether diaminetetraacetate and complex salts thereof with citric acid, tartaric acid and malic acids; persulfates; bromates; permanganates; and nitrobenzenes. Among them, iron (III) complex salts of aminopolycarboxylic acids such as iron (III) complex salt of ethylenediaminetetraacetic acid and persulfates are preferred from the viewpoints of the rapid process and prevention of environmental pollution. The iron (III) complex salts of aminopolycarboxylic acids are particularly effective in both bleaching solution and bleach-fixing solution. The pH of the bleaching solution or bleach-fixing solution containing such an iron (III) complex salt of aminopolycarboxylic acid is usually 5.5 to 8. For acceleration of the process, a lower pH can also be employed.

The bleaching solution, bleach-fixing solution, pre-bleaching bath and pre-bleach-fixing bath may contain a bleaching accelerator, if necessary. Examples of the bleaching accelerators include compounds having a mercapto group or disulfide bond described in U.S. Pat. No. 3,893,858, West German Patent No. 1,290,812, J.P. KOKAI No. Sho 53-95,630 and Research Disclosure No. 17,129 (July, 1978); thiazolidine derivatives described in J.P. KOKAI No. Sho 50-140,129; thiourea derivatives described in U.S. Pat. No. 3,706,561; iodides described in J. P. KOKAI No. Sho 58-16,235; polyoxyethylene compounds described in West German Patent No. 2,748,430; polyamine compounds described in J.P. KOKOKU No. Sho 45-8836; and bromide ions. Among them, the compounds having a mercapto group or disulfide group are preferred, since they have a remarkable acceleration effect. Compounds described in U.S. Pat. No. 3,893,858, West German Patent No. 1,290,812 and J.P. KOKAI No. Sho 53-95,630 are particularly preferred. Further compounds described in U.S. Pat. No. 4,552,834 are also preferred. These bleach-accelerators may be added to the photosensitive material. When a color photosensitive material is to be bleach-fixed, these bleaching accelerators are particularly effective.

The fixing agents include, for example, thiosulfates, thiocyanates, thioether compounds, thioureas and a large amount of iodides. Among them, the thiosulfates are commonly used and ammonium thiosulfate is most widely usable. Preferred examples of the preservatives for the bleach-fixing solutions include sulfites, hydrogensulfites, sulfinates and carbonylhydrogensulfite adducts.

The silver halide color photographic material photosensitive material used in the present invention is usually subjected to washing with water and/or stabilization step after desilverization. The amount of water used in the washing step varies in a wide range depending on the properties of the photosensitive material (such as couplers used), application thereof, temperature of water used for washing, number of the tanks used for washing with water (number of stages), replenishing method such as counter flow or down-flow system and various other conditions. Among them, the relationship between the number of the tanks for washing with water and the amount of water in the multi-stage counter flow system can be determined by a method described in "Journal of the Society of Motion Picture and Television Engineers", Vol. 64, pages 248 to 253 (May, 1955).

Although the amount of water necessitated for washing can be remarkably reduced by the multi-stage counter flow system described in the above-described Journal, another problem is posed in this method that bacteria propagate themselves while the water is kept for a longer time in the tanks and, as a result, a suspended matter thus formed is fixed on the sensitive material. For solving this problem in the processing of the color photosensitive material of the present invention, a quite effective method for reducing in amount of calcium ion and magnesium ion described in J. P. KOKAI No. 62-288838 can be employed. Further this problem can be solved also by using isothiazolone compounds described in J. P. KOKAI No. Sho 57-8,542, thiabendazoles, chlorine-containing germicides such as chlorinated sodium isocyanurates, benzotriazoles and germicides described in Hiroshi Horiguchi "Bokin Bobai-zai no Kagaku", "Biseibutsu no Mekkin, Sakkin, Bobai Gijutsu" edited by Eisei Gijutsu-kai and "Bokinbobaizai Jiten" edited by Nippon Bokinbobai Gakkai.

The pH of water used for washing the photosensitive material of the present invention is 4 to 9, preferably 5 to 8. The temperature of water to be used for washing and the washing time which vary depending on the properties and use of the photosensitive material are usually 15° to 45° C. and 20 sec to 10 min, respectively, and preferably 25° to 40° C. and 30 sec to 5 min. The photosensitive material of the present invention can be processed directly with a stabilizing solution in place of washing with water. The stabilization can be conducted by any of known processes described in J. P. KOKAI Nos. Sho 57-8,543, Sho 58-14,834 and Sho 60-220,345.

The washing process with water may be followed by a stabilization process. In the stabilization, a stabilizing bath containing formalin and a surfactant which is usually used as the final bath for a color photographic photosensitive material for taking pictures can be used. The stabilizing bath may also contain chelating agents and mold-proofing agents.

An overflow obtained by washing with water or replenishing the stabilizing solution can be used again in another step such as desilverization step and other steps.

The silver halide color photosensitive material used in the present invention may contain a color developing agent for the purpose of simplifying and accelerating the process. The color developing agents are preferably used in the form of precursors thereof. Examples of them include indoaniline compounds described in U.S. Pat. No. 3,342,597, Schiff base compounds disclosed in U.S. Pat. No. 3,342,599, Research Disclosure Nos. 14,850 and 15,159, aldol compounds described in Research Disclosure No. 13,924, metal salt complexes described in U.S. Pat. No. 3,719,492 and urethane compounds described in J.P. KOKAI No. sho 53-135,628.

The color phootosensitive material comprising a silver halide of the present invention may contain a 1-phenyl-3-pyrazolidone compound, if necessary, for the purpose of accelerating the color development. Typical examples of the compounds are described in J. P. KOKAI Nos. Sho 56-64,339, Sho 57-144,547 and Sho 58-115,438.

The temperature of the processing solutions used in the present invention are controlled at 10° to 50° C. The standard temperature is 33° to 38° C., but a higher temperature can be employed to accelerate the process and thereby to reduce the process time or, on the contrary, a lower temperature can also be employed to improve the quality of the image and stability of the processing liquid. To save silver in the photosensitive material, intensification with cobalt or hydrogen peroxide as described in West German Patent No. 2,226,770 and U.S. Pat. No. 3,674,499 can be employed.

The processing liquids of the present invention can be used for processing any silver halide color photographic material. They can be used for processing, for example, a color paper, reversal color paper, positive color film, negative color film, reversal color film and direct positive color photosensitive material. They are used particularly preferably for processing photosensitive material for printing such as color paper and reversal color paper.

The silver halide emulsion for forming the photosensitive material used in the present invention may comprise any halogen composition such as silver bromoiodide, silver bromide, silver chlorobromide or silver chloride.

In the rapid process or when the amount of the replenisher is to be reduced, a silver chlorobromide emulsion or silver chloride emulsion containing at least 60 molar % of silver chloride is preferably used. The emulsion containing 80 to 100 molar % of silver chloride is still preferred and that containing 90 to 99.9 molar % is particularly preferred. When a high sensitivity is necessitated or when the fogging should be strictly inhibited in the course of the production, storage and/or process, a silver chlorobromide emulsion or silver bromide emulsion containing at least 50 molar % of silver bromide is preferably used and that containing at least 70 molar % thereof is still preferably used. Although the rapid process becomes difficult when silver bromide content is increased to 90 molar % or above, the development can be accelerated to some extent irrespective of the silver bromide content by using a development accelerator such as a silver halide solution, fogging agent or developing agent in the process. This technique is sometimes preferred. In both cases, use of silver iodide in a large amount is undesirable. The amount of silver iodide should be not more than 3 molar %. Such a silver halide emulsion is preferably used mainly for photosensitive materials for printing such as color papers.

The silver halides to be contained in the color photographic photosensitive materials for photographing (negative films and reversal films) are preferably silver bromoiodide and silver chlorobromoiodide. Silver iodide content is preferably 3 to 15 molar %.

The silver halide grains used in the present invention may comprise a core and a surface layer (core/shell grains) or a homogeneous phase or it may have a polyphase structure (conjugated structure) or, alternatively, the grains may comprise a combination of them.

The average size of the silver halide grains (in terms of grain diameter when the grains are spherical or nearly spherical, or edge length when the grains are cubic, and they are given in terms of average based on the projection area) (the average size of tabular grains is given in terms of that of the spherical grains) used in the present invention is preferably 0.1 to 2 μm, still preferably 0.15 to 1.5 μm. The grain size distribution is either narrow or wide. The coefficient of variation calculated by dividing the standard deviation in the grain size distribution curve of the silver halide emulsion by the average grain size is preferably not higher than 20%, still preferably not higher than 15% and particularly preferably not higher than 10% (so-called monodisperse silver halide emulsion) in the present invention. To satisfy an intended gradation, a layer may comprise a mixture of two or more monodisperse silver halide emulsions (preferably having the above-described coefficient of variation) having different grain sizes or the emulsions may be used for forming respective laminated layers having substantially the same color sensitivity. Further a combination of two or more polydisperse silver halide emulsions or a combination of a monodisperse emulsion with a polydisperse emulsion can be used in the form of a mixture or by forming a laminated layers thereof.

The silver halide grains used in the present invention may be in a regular crystal form such as cubic, octahedral, rhombo-dodecahedral or tetradecahedral form or a mixture of them; or an irregular crystal form such as spherical form; or a complex crystal form thereof. They may also be tabular grains. Particularly an emulsion wherein at least 50% of the total projection area of the grains comprise tabular grains having a length/thickness ratio of at least 5, particularly at least 8 is usable. The emulsion may comprise a mixture of grains having various crystal forms. The emulsion may be of a surface-latent-image type for forming a latent image mainly on the surfaces thereof or of an internal latent-image type for forming a latent image in the grains.

The photographic emulsions usable in the present invention can be produced by a method disclosed in Research Disclosure (RD), Vol. 176, Item No. 17643, (Paragraphs I, II and III) (December, 1978).

The silver halide emulsion to be used in the present invention is usually physically and chemically ripened and spectrally sensitized. The additives to be used in these steps are shown in Research Disclosure, Vol. 176, No. 17643 (December, 1978) and Vol. 187, No. 18716 (November, 1979). The portions in which the additives are mentioned in these two Research Disclosure's are summarized in the following table.

Known photographic additives usable in the present invention are also mentioned in the two Research Disclosures and the corresponding portions are also shown in the following table.

| | Additive | RD 17643 | RD 18716 |
|---|---|---|---|
| 1 | Chemical sensitizer | p. 23 | right column, p. 648 |
| 2 | Sensitivity improver | " | " |
| 3 | Spectral sensitizer | pp. 23 to 24 | right column, p. 648 to left column, p. 649 |
| 4 | Supersensitizer | " | |
| 5 | Brightening agent | p. 24 | |
| 6 | Antifoggant and stabilizer | pp. 24 to 25 | right column, p. 649 |
| 7 | Coupler | p. 25 | " |
| 8 | Organic solvent | p. 25 | " |
| 9 | Light absorber and filter dye | pp. 25 to 26 | right column, p. 649 to left column, p. 650 |
| 10 | U.V. absorber | " | right column, p. 649 to left column, p. 650 |
| 11 | Antistaining agent | right column, p. 25 | left and right columns, p. 650 |
| 12 | Dye image stabilizer | p. 25 | left and right columns, p. 650 |
| 13 | Hardener | p. 26 | left column, p. 651 |
| 14 | Binder | p. 26 | " |
| 15 | Plasticizer and lubricant | p. 27 | right column, p. 650 |
| 16 | Coating aid and surfactant | pp. 26–27 | " |
| 17 | Antistatic agent | p. 27 | " |

Various color couplers can be used in the present invention. The color couplers herein indicate compounds capable of coupling with an oxidation product of an aromatic primary amine developing agent to form a dye. Typical examples of the useful color couplers include naphthol or phenol compounds, pyrazolone or pyrazoloazole compounds and open chain or heterocyclic ketomethylene compounds. Examples of these cyan, magenta and yellow couplers usable in the present invention are described in patents cited in Research Disclosure (RD) 17643 (December, 1978) VII-D and 18717 (November, 1979).

The color couplers contained in the photosensitive material preferably has a ballast group or they are made nondiffusible by polymerization. When a divalent color couplers wherein the active coupling portions are substituted with a coupling-off group are used, the amount of silver to be applied for forming a coating is smaller than that required when a tetravalent color coupler having hydrogen atoms at the active coupling portions is used. Couplers capable of forming a colored compound having suitable diffusing properties, colorless compound-forming couplers, DIR couplers capable of releasing a development inhibitor by coupling reaction or couplers capable of releasing a development accelerator are also usable.

Typical examples of the yellow couplers usable in the present invention include oil protection type acylacetamide couplers such as those described in U.S. Pat. Nos. 2,407,210, 2,875,057 and 3,265,506. Divalent yellow couplers are preferably used in the present invention. Typical examples of them include yellow couplers of oxygen-linked coupling-off type such as those disclosed in U.S. Pat. Nos. 3,408,194, 3,447,928, 3,933,501 and 4,022,620, and yellow couplers of nitrogen-linked coupling-off type such as those disclosed in J. P. KOKOKU No Sho 55-10739, U.S. Pat. Nos. 4,401,752 and 4,326,024, RD 18053 (April, 1979), British Patent No. 1,425,020, and West German Public Disclosure Nos. 2,219,917, 2,261,361, 2,329,587 and 2,433,812. α-Pivaloylacetanilide couplers provide excellent fastness, particularly light fastness, of the developed dye and, on the other hand, α-benzoylacetaniline couplers provide a high developed color density.

The magenta couplers usable in the present invention include oil-protection type indazolone or cyanoacetyl couplers, preferably 5-pyrazolone and pyrazoloazole couplers such as pyrazolotriazoles. Among the 5 pyrazolone couplers, those having an arylamino group or an acylamino group at 3-position are preferred in view of the hue of the developed color and the developed color density. Typical examples of them are mentioned in U.S. Pat. Nos. 2,311,082, 2,343,703, 2,600,788, 2,908,573, 3,062,653, 3,152,896 and 3,936,015. Nitrogen-linked coupling-off groups described in U.S. Pat. No. 4,310,619, and arylthio groups mentioned in U.S. Pat. No. 4,351,897 are particularly preferred as the releasing group of the 2-equivalent 5-pyrazolone couplers. 5-Pyrazolone couplers having a ballast group mentioned in European Patent No. 73,636 provide a high developed color density.

Examples of the pyrazoloazole couplers include pyrazolobenzimidazoles described in U.S. Pat. No. 3,369,879, preferably pyrazolo [5,1-c][1,2,4]triazoles described in U.S. Pat. No. 3,725,067, pyrazolotetrazoles described in Research Disclosure 24220 (June, 1984) and pyrazolopyrazoles described in Research Disclosure 24230 (June, 1984). Imidazo[1,2-b]pyrazoles described in European Patent No. 119,741 are preferred because of low yellow sub-absorption and light fastness of the developed dye, and pyrazolo[1,5-b][1,2,4]triazole described in European Patent No. 119,860 is particularly preferred.

The cyan couplers usable in the present invention include oil-protection-type naphthol and phenol couplers. Examples of them include naphthol couplers described in U.S. Pat. No. 2,474,293, preferably oxygen-linked coupling-off type 2-equivalent naphthol couplers described in U.S. Pat. Nos. 4,052,212, 4,146,396, 4,228,233 and 4,296,200. Examples of the phenol couplers are described in U.S. Pat. Nos. 2,369,929, 2,801,171, 2,772,162 and 2,895,826. The cyan couplers stable to moisture and temperature are preferably used in the present invention. Typical examples of them include phenolic cyan couplers having an alkyl group higher than ethyl group inclusive at m-position of the phenol nucleus as described in U.S. Pat. No. 3, 772,002; 2,5-diacylamino-substituted phenol couplers as described in U.S. Pat. Nos. 2,772,162, 3,758,308, 4,126,396, 4,334,011 and 4,327,173, West German Patent Public Disclosure No. 3,329,729 and J. P. KOKAI No. Sho 59-166956; and phenol couplers having a phenylureido group at 2-position and an acylamino group at 5-position as described in U.S. Pat. Nos. 3,446,622, 4,333,999, 4,451,559 and 4,427,767.

The graininess can be improved by using an additional coupler to provide colored dye which is suitably diffusible. Examples of such couplers include magenta couplers described in U.S. Pat. No. 4,366,237 and British Patent No. 2,125,570; and yellow, magenta and cyan couplers described in European Patent No. 96,570 and West German Public Disclosure No. 3,234,533.

The dye-forming couplers and the above-mentioned, special couplers may form a dimer or a higher polymer. Typical examples of the polymerized dye-forming couplers are described in U.S. Pat. Nos. 3,451,820 and 4,080,211. Examples of the polymerized magenta cyan couplers are described in British Patent No. 2,102,173 and U.S. Pat. No. 4,367,282.

Two or more of the couplers usable in the present invention can be incorporated into one photosensitive layer or, alternatively, one compound can be incorporated into two or more different layers in order to satisfy the properties required of the photosensitive material.

The standard amount of the color coupler ranges from 0.001 to 1 mol per mol of the photosensitive silver halide. Preferably the yellow coupler is used in an amount of 0.01 to 0.5 mol, magenta coupler is used in an amount of 0.003 to 0.3 mol and cyan coupler is used in an amount of 0.002 to 0.3 mol.

The coupler can be incorporated into a photosensitive layer by various known techniques in the present invention. Usually, the coupler can be incorporated therein by an oil-in-water dispersion method known as an oil protecting method, wherein the coupler is dissolved in a solvent and the solution is emulsion-dispersed in an aqueous gelatin solution containing a surfactant. In another method, water or an aqueous gelatin solution is added to a coupler solution containing a surfactant and then the oil-in-water dispersion is produced by phase inversion. An alkali-soluble coupler can be dispersed by so-called Fisher dispersion method. In still another method, a low-boiling organic solvent is removed from the coupler dispersion by noodle washing or ultrafiltration and the residue is mixed with a photographic emulsion.

As a dispersion medium for the coupler, a high-boiling organic solvent having a dielectric constant (25° C.) of 2 to 20 and refractive index (25° C.) of 1.5 to 1.7 and/or a water-insoluble polymeric compound is preferably used.

Preferred high-boiling organic solvents are those of the following general formulae (A) to (E):

general formula (A):

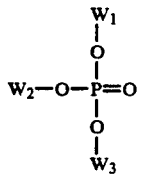

general formula (B):

$$W_1-COO-W_2$$

general formula (C):

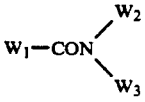

-continued general formula (D):

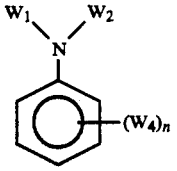

general formula (E):

$$W_1-O-W_2$$

wherein $W_1$, $W_2$ and $W_3$ each represent a substituted or unsubstituted alkyl group, cycloalkyl group, alkenyl group, aryl group or heterocyclic group, $W_4$ represents $W_1$, $OW_1$ or $S-W_1$, n represents an integer of 1 to 5 and when n is 2 or larger, $W_4$'s may be the same or different from each other and $W_1$ and $W_2$ in the general formula (E) may be bonded together to form a condensed ring.

The high-boiling organic solvents usable in the present invention include also compounds having a melting point of not higher than 100° C. and a boiling point of 140° C. or above which are immiscible with water and usable as a good solvent for the coupler, in addition to those of the general formulae (A) through (E). The melting point of the high-boiling organic solvents is preferably not higher than 80° C. The boiling point of the high-boiling organic solvents is preferably not lower than 160° C., still preferably not lower than 170° C.

The details of the high-boiling organic solvents are described from the right lower column, page 137 to right upper column, page 144 of J. P. KOKAI No. Sho 62-215272.

In addition, the coupler can be impregnated with a loadable latex polymer (see; for example, U.S. Pat. No. 4,203,716) in the presence or absence of the above-described high-boiling organic solvent or dissolved in a water-insoluble, organic solvent-soluble polymer and then it is emulsion-dispersed in an aqueous solution of a hydrophilic colloid.

Homopolymers or copolymers described in International Publication WO 88/00723 (pages 12 to 30) are preferably used and acrylamide polymers are particularly preferred from the viewpoint of stabilization of the color image.

The photosensitive materials produced according to the present invention may contain a hydroquinone derivative, aminophenol derivative, gallic acid derivative or ascorbic acid derivative as a color antifoggant.

The photosensitive material of the present invention may contain various fading inhibitors. Typical examples of the organic fading inhibitors for cyan, magenta and/or yellow images include hydroquinones, 6-hydroxychromans, 5-hydroxycoumarans, spirochromans, p-alkoxyphenols, hindered phenols such as bisphenols, gallic acid derivatives, methylenedioxybenzenes, aminophenols and hindered amines as well as ether or ester derivatives produced by silylating or alkylating the phenolic hydroxyl group of these compounds. In addition, metal complexes such as (bissalicylaldoxymato)-nickel complexes and (bis-N,N-dialkyldithiocarbamato)nickel complexes are also usable.

Examples of the organic fading inhibitors are described in the specifications of the patents described below.

The hydroquinones are described in U.S. Pat. Nos. 2,360,290, 2, 418,613, 2,700,453, 2,701,197, 2,728,659, 2,732,300, 2,735,765, 3,982, 944 and 4,430,425, British Patent No. 1,363,921 and U.S. Pat. Nos. 2,710,801 and 2,816,028; 6-hydroxychromans, 5-hydroxycoumarans and spirochromans are described in U.S. Pat. Nos. 3,432,300, 3,573,050, 3,574,627, 3,698,909 and 3,764,337 and J. P. KOKAI No. Sho 52-152225; spiroindanes are described in U.S. Pat. No. 4,360,589; p-alkoxyphenols are described in U.S. Pat. No. 2,735,765, British Patent No. 2,066,975, J. P. KOKAI No. Sho 59-10539 and J. P. KOKOKU No. Sho 57-19765; hindered phenols are described in U.S. Pat. No. 3,700, 455, J. P. KOKAI No. Sho 52-72224, U.S. Pat. No. 4,228,235 and J. P. KOKOKU No. Sho 52-6623; gallic acid derivatives, methylenedioxybenzenes and aminophenols are described in U.S. Pat. Nos. 3,457,079 and 4,332,886 and J. P. KOKOKU No. Sho 56-21144; hindered amines are described in U.S. Pat. Nos. 3,336,135 and 4,268,593, British Patent Nos. 1,326,889, 1,354,313 and 1,410,846, J. P. KOKOKU No. Sho 51-1420, J. P. KOKAI Nos. Sho 58-114036, Sho 59-53846 and Sho 59-78344; and metal complexes are described in U.S. Pat. Nos. 4,050,938 and 4,241, 155 and British Patent No. 2,027,731 (A). These compounds are used usually in an amount of 5 to 100% by weight based on the corresponding color coupler. They are coemulsified with the coupler and incorporated into the photosensitive layer to attain the object. For preventing deterioration of a cyan dye image by heat and particularly by light, it is effective to introduce an ultraviolet ray-absorbing agent into a cyan coupling layer and layers adjacent thereto.

The Ultraviolet ray-absorbing agents usable in the present invention include benzotriazole compounds substituted with an aryl group (such as those described in U.S. Pat. No. 3,533,794), 4-thiazolidone compounds (such as those described in U.S. Pat. Nos. 3,314,794 and 3,352,681), benzophenone compounds (such as those described in J. P. KOKAI No. Sho 46-2784), cinnamic ester compounds (such as those described in U.S. Pat. Nos. 3,705,805 and 3,707,375), butadiene compounds (such as those described in U.S. Pat. No. 4,045,229) and benzoccidol compounds (such as those described in U.S. Pat. Nos. 3,406,070, 3,677,672 and 4,271,307). Further U.V. ray-absorbing couplers (such as cyan dye-forming α-naphthol couplers) and U.V. ray-absorbing polymers are also usable. These U.V. absorbing agents may be mordanted in a given layer.

Among them, the benzotriazole compounds substituted with an aryl group are preferred.

It is also preferred to use a compound which will be described below together with the above-described couplers, particularly a combination with a pyrazoloazole coupler is preferred.

To prevent staining by a colored dye formed by reaction of the coupler with the color developing agent or its oxidation product remaining in the film during the storage after the processing of the film or to prevent other adverse reactions, it is preferred to use a compound (F) capable of being chemically bonded with an aromatic amine developing agent remaining after the color development process to form a chemically inert, substantially colorless compound and/or a compound (G) capable of being chemically bonded with an oxidation product of an aromatic amine developing agent remaining after the color development process to form a chemically inert, substantially colorless compound.

Preferred compounds (F) include those having a rate constant $k_2$ of second-order reaction with p-anisidine (in 80° C. trioctyl phosphate) of 1.0 l /mol sec to $1\times10^{-5}$ l /mol. The rate constant of second-order reaction can be determined by a method described in J. P. KOKAI No. 63-158545.

When $k_2$ is above this range, the compound per se is unstable and is decomposed by reaction with gelatin or water. When k, is below this range, on the contrary, the rate of reaction with the remaining aromatic amine developing agent is too low to inhibit the adverse reaction of the remaining aromatic amine developing agent.

In the compounds (F), preferred are those of the following general formula (FI) or (FII):

general formula (FI): $R_1—(A)_a—X$ general formula (FII): $R_2—C(B)=Y$ wherein $R_1$ and $R_2$ each represent an aliphatic group, aromatic group or heterocyclic group, n represents 1 or 0, A represents a group capable of reacting with the aromatic amine developing agent to form a chemical bond, X represents a group which is eliminated by reaction with the aromatic amine developing agent, B represents a hydrogen atom, aliphatic group, aromatic group, heterocyclic group, acyl group or sulfonyl group, Y represents a group which accelerates the addition of the aromatic amine developing agent to the compound of the general formula (FII), and $R_1$ and X, Y and $R_2$ or B may be bonded together to form a cyclic structure.

Typical processes for chemically bonding with the remaining aromatic amine developing agent include substitution reaction and addition reaction processes.

Preferred examples of the compounds of the general formulae (FI) and (FII) include those described in J.P. KOKAI Nos..Sho 63-158545 and Sho 62-283338, and European Patent KOKAI Nos. 298,321 and 277,589.

Still preferred examples of the compounds (G) capable of being chemically bonded with an oxidation product of an aromatic amine developing agent remaining after the color development process to form a chemically inert, substantially colorless compound are those of the following general formula (GI):

general formula (GI): R—Z wherein R represents an aliphatic group, aromatic group or heterocyclic group and Z represents a nucleophilic group or a group which is decomposed in the photosensitive material to release a nucleophilic group.

Z in the general formula (GI) is preferably a group having a Pearson's nucleophilic" $CH_3I$ value [R. G. Pearson, et al., J. Am. Chem. Soc., 90 , 319 (1968)] of at least 5 or a group derived therefrom.

Preferred examples of the compounds of general formula (GI) are described in European Patent Publication No. 255,722A, J. P. KOKAI Nos. Sho 62-143048 and Sho 62-229145, Japanese Patent Application Nos. Sho 63-136724 and Sho 62-214681 and European Patent Kokai Nos. 298,321 and 277,589.

The details of the combination of the compounds (G) and (F) are described in European Patent Publication No. 277,589A.

The photosensitive materials produced according to the present invention may contain, in its hydrophilic colloid layer, a water-soluble dye or a dye which becomes water-soluble by photographic processes as a filter dye or for the purpose of, for example, inhibiting irradiation or halation. Examples of such dyes include oxonol dyes, hemioxonol dyes, styryl dyes, merocyanine dyes, cyanine dyes and azo dyes. Among them, the oxonol dyes, hemioxonol dyes and merocyanine dyes are preferred.

Gelatin is preferably used as a binder or protective colloid in the emulsion layers of the photosensitive material of the present invention. Other hydrophilic colloids can also be used singly or in combination with gelatin.

Gelatin used in the present invention may be any of those processed with lime or with an acid. The details of the processes for producing gelatin are described in Arthur Weiss "The Macromolecular Chemistry of Gelatin" (published by Academic Press in 1964).

The photographic photosensitive material used in the present invention is applied to an ordinary flexible support such as a plastic film (e.g. cellulose nitrate, cellulose acetate or polyethylene terephthalate film) or paper; or a rigid support such as a glass support. The details of the supports and coating methods are described in Research Disclosure No. 176, Item 17643Xv (p. 27) and XVII (p. 28) (December, 1978).

The use of a reflecting support is preferred in the present invention. The term "reflecting support" herein incidates a support having an improved reflectivity so as to form a clear dye image in the silver halide emulsion layer. The reflecting supports are produced by coating the support with a dispersion of a light-reflecting substance such as titanium oxide, zinc oxide, calcium carbonate or calcium sulfate in a hydrophobic resin. Further supports made of a hydrophobic resin containing such a light-reflecting substance dispersed therein are also usable.

EXAMPLES

The following examples will further illustrate the present invention, which by no means limit the invention.

EXAMPLE 1

A multi-layered color photographic paper having the following layer construction was produced by subjecting a paper support the both surfaces of which had been laminated with polyethylene to a corona discharge process, forming a gelatin prime layer containing sodium dodecylbenzenesulfonate thereon and forming various photographic layers thereon by coating. The coating solutions were prepared as follows:

Preparation of coating solution for forming the first layer 27.2 ml of ethyl acetate, 4.1 g of a solvent (Solv-3) and 4.1 g of another solvent (Solv-7) were added to a mixture of 19.1 g of yellow coupler (ExY), 4.4 g of a color image stabilizer (cpd-1) and 0.7 g of another color image stabilizer (Cpd-7) to prepare a solution, which was emulsion-dispersed in 185 ml of 10 % aqueous gelatin solution containing 8 ml of 10% sodium dodecylbenzenesulfonate to form emulsified dispersion A. On the other hand, silver chlorobromide emulsion A [a mixture of a large size grain emulsion A of cubic grains having an average grain size of 0.88 μm and a small size grain emulsion A of a grain size of 0.70 μm in a molar ratio of 3:7 (in terms of silver); coefficient of variation of grain size distribution: 0.08 and 0.10, respectively; and each containing 0.3 molar % of silver bromide in a part of the grain surface). They contained $2.0\times10^{-4}$ mol (large size emulsion A) or $2.5\times10^{-4}$ mol (small size emulsion A), per mol of silver, of a blue-sensitive sensitizing dye A or B which will be described below. They were chemically aged with a sulfur sensitizer and a gold sensitizer. The emulsified dispersion A was mixed with the silver chlorobromide emulsion A to form the first layer-forming solution.

Coating solutions for forming the second layer through the seventh layer were prepared in the same manner as that for forming the first layer-forming coating solution. Sodium salt of 1-hydroxy-3,5-dichloro-s-triazine was used as the gelatin hardener in each layer.

Cpd-10 in a total amount of 25.0 mg/m$^2$ and Cpd-11 in a total amount of 50.0 mg/m$^2$ were incorporated into the respective layers.

The following spectral sensitizing dyes were contained in the silver chlorobromide emulsions for forming the respective photosensitive emulsion layers:

Sensitizing dye A for blue-sensitive emulsion layer:

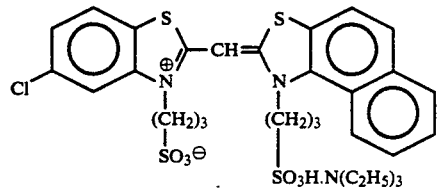

Sensitizing dye B for blue-sensitive emulsion layer:

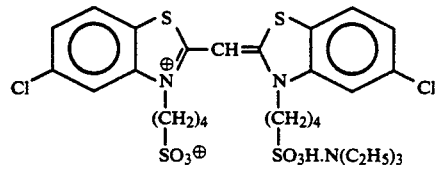

($2.0\times10^{-4}$ mol, per mol of the silver halide, for the large-size grain emulsion A and $2.5\times10^{-4}$ mol for the small-size grain emulsion A)

Sensitizing dye C for green-sensitive emulsion layer:

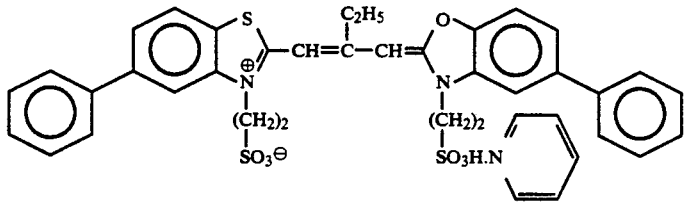

($4.0\times10^{-4}$ mol, per mol of the silver halide, for the large-size grain emulsion B and $5.6\times10^{-4}$ mol for the small-size grain emulsion B) and Sensitizing dye D for green-sensitive emulsion layer:

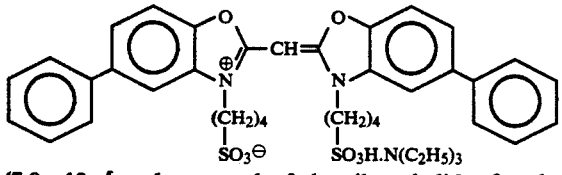

($7.0\times10^{-5}$ mol, per mol of the silver halide, for the large-size grain emulsion B and $1.0\times10^{-5}$ mol for the small-size grain emulsion B)

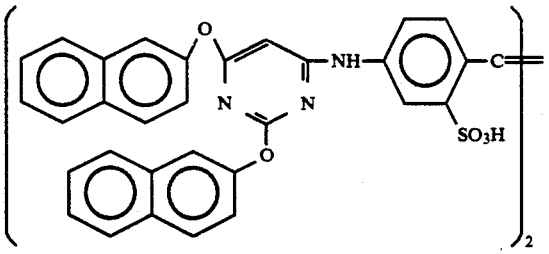

Sensitizing dye E for red-sensitive emulsion layer:

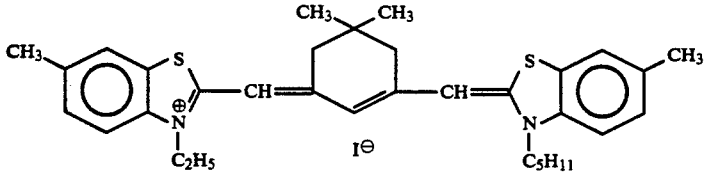

($0.9\times10^{-4}$ mol, per mol of the silver halide, for the large-size grain emulsion C and $1.1\times10^{-4}$ mol for the small-size grain emulsion C)

$2.6\times10^{-3}$ mol, per mol of the silver halide, of the following compound was incorporated into the red-sensitive emulsion layer:

$8.5\times10^{-5}$ mol, $7.7\times10^{-4}$ mol and $2.5\times10^{-4}$ mol, per mol of the silver halide, of 1-(5-methylureidophenyl)-5-mercaptotetrazole was incorporated into the blue-sensitive emulsion layer, green-sensitive emulsion layer and red-sensitive emulsion layer, respectively.

$1\times10^{-4}$ mol and $2\times10^{-4}$ mol, per mol of the silver halide, of 4-hydroxy-6-methyl-1,3,3a,7-tetrazaindene was incorporated into the blue-sensitive emulsion layer and green-sensitive emulsion layer, respectively.

The following dyes were incorporated into the emulsion layers in order to prevent irradiation (the numeral in the parentheses indicates the amount applied to form a coating layer):

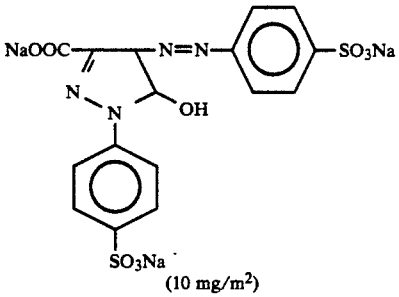

(10 mg/m²)

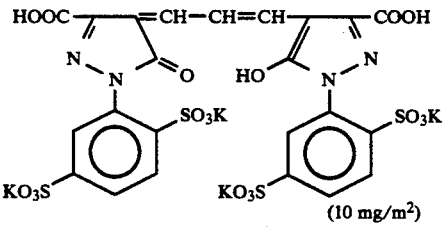

(10 mg/m²)

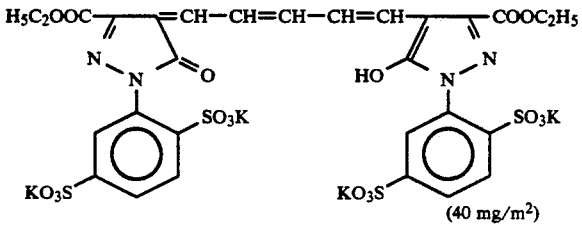

(40 mg/m²)

-continued and

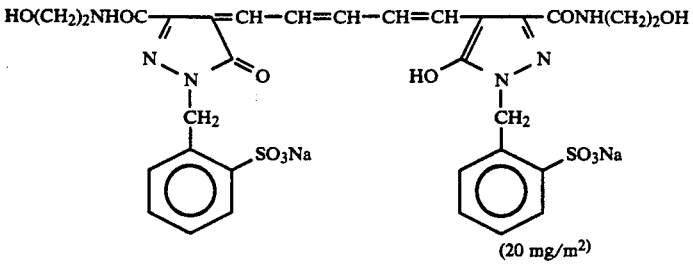

Layer Construction

The compositions of the respective layers will be shown below. The numerals represents the amount (g/m$^2$) of the components used for forming the layers. The amount of the silver halide emulsion is given in terms of silver used for forming the layer.

| | |
|---|---|
| Support: | |
| Polyethylene-laminated papaer [containing a white dye ($TiO_2$) and a blue dye (ultramarine) in the polyethylene layer on the first layer side] | |
| The first layer (blue-sensitive layer): | |
| Above-described silver chlorobromide emulsion A | 0.30 |
| Gelatin | 1.86 |
| Yellow coupler (ExY) | 0.82 |
| Color image stabilizer (Cpd-1) | 0.19 |
| Solvent (Solv-3) | 0.18 |
| Solvent (Solv-7) | 0.18 |
| Color image stabilizer (Cpd-7) | 0.06 |
| The second layer (color mixing-inhibition layer) | |
| Gelatin | 0.99 |
| Color mixing inhibitor (Cpd-5) | 0.08 |
| Solvent (Solv-1) | 0.16 |
| Solvent (Solv-4) | 0.08 |
| The third layer (green-sensitive layer) | |
| Silver chlorobromide emulsion [mixture of large size emulsion B of cubic grains having average grain size of 0.55 μm and small size emulsion B of those of 0.39 μm in a molar ratio of 1:3 (in terms of Ag); Coefficient of variation of grain size distribution being 0.10 and 0.08; 0.8 molar % of AgBr being contained in a part of the surface layer of the grains in each emulsion] | 0.12 |
| Gelatin | 1.24 |
| Magenta coupler (ExM) | 0.23 |
| Color image stabilizer (Cpd-2) | 0.03 |
| Color image stabilizer (Cpd-3) | 0.16 |
| Color image stabilizer (Cpd-4) | 0.02 |
| Color image stabilizer (Cpd-9) | 0.02 |
| Solvent (Solv-2) | 0.40 |
| The fourth layer (ultraviolet ray-absorbing layer) | |
| Gelatin | 1.58 |
| Ultraviolet ray-absorbing agent (UV-1) | 0.47 |
| Color mixing-inhibiting agent (Cpd-5) | 0.05 |
| Solvent (Solv-5) | 0.24 |
| The fifth layer (red-sensitive emulsion layer) | |
| Silver chlorobromide emulsion [mixture of large-size grain emulsion C of cubic grains having average grain size of 0.58 μm and small-size grain emulsion C of those of 0.45 μm in a molar ratio of 1:4 (in terms of Ag); Coefficient of variation of grain size distribution being 0.09 and 0.11; 0.6 molar % of AgBr being contained in a part of the surface layer of the grains in each emulsion] | 0.23 |
| Gelatin | 1.34 |
| Cyan coupler (ExC) | 0.32 |
| Color image stabilizer (Cpd-2) | 0.03 |
| Color image stabilizer (Cpd-4) | 0.02 |
| Color image stabilizer (Cpd-6) | 0.18 |
| Color image stabilizer (Cpd-7) | 0.40 |
| Color image stabilizer (Cpd-8) | 0.05 |
| Solvent (Solv-6) | 0.14 |
| The sixth layer (ultraviolet ray-absorbing layer) | |
| Gelatin | 0.53 |
| Ultraviolet ray-absorbing agent (UV-1) | 0.16 |
| Color mixing-inhibitor (Cpd-5) | 0.02 |

-continued

| | |
|---|---|
| Solvent (Solv-5) | 0.08 |
| The seventh layer (protective layer) | |
| Gelatin | 1.33 |
| Acryl-modified copolymer of polyvinyl alcohol (degree of modification; 17%) | 0.17 |
| Liquid paraffin | 0.03 |

(ExY) Yellow coupler:

Mixture of compounds of the following formula:

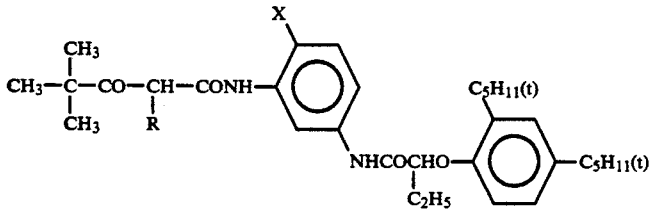

wherein R represents

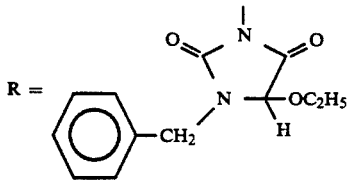

and X represents Cl,
and wherein R represents

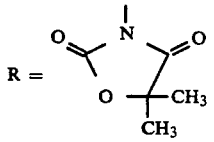

and X represents $OCH_3$ in a molar ratio of 1:1

(ExM) Magenta coupler:

Compound of the following formula:

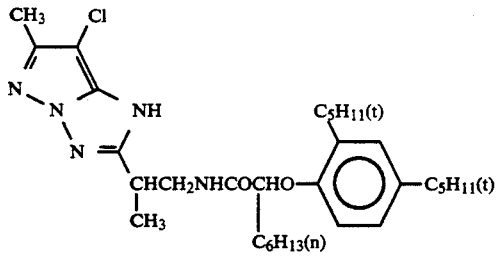

(ExC) Cyan coupler:

Mixture of compounds of the following formulae:

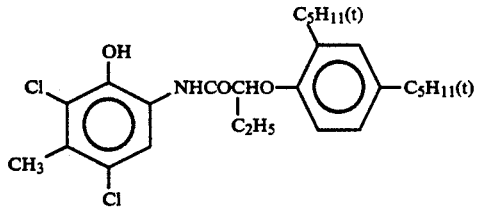

and

-continued
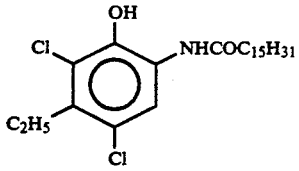
in a molar ratio of 1:1
(Cpd-1) Color image stabilizer:
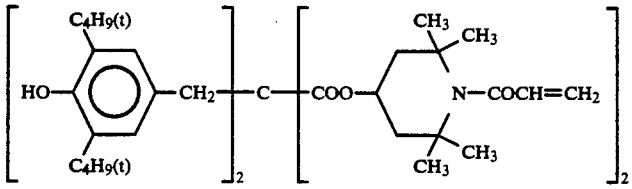
(Cpd-2) Color image stabilizer:
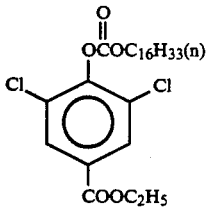
(Cpd-3) Color image stabilizer:
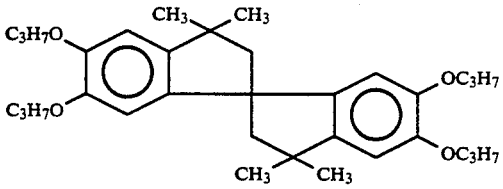
(Cpd-4) Color image stabilizer:
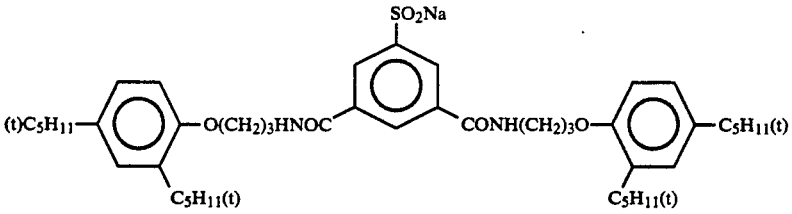
(Cpd-5) Color-mixing inhibitor:
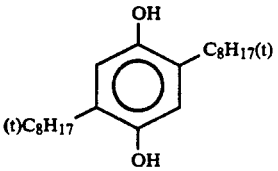
(Cpd-6) Color image stabilizer:
Mixture of compounds of the following formulae:

-continued
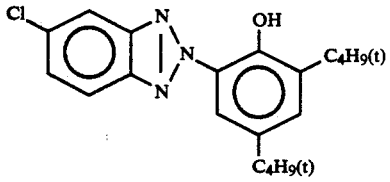
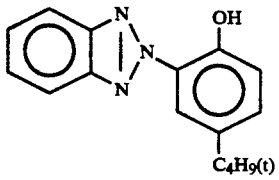
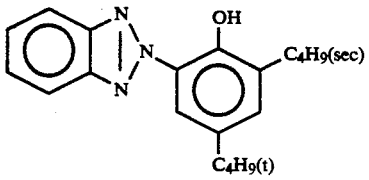
in a weight ratio of 2:4:4.
(Cpd-7) Color image stabilizer:
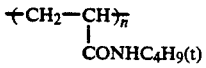
average molecular weight: 60,000
(Cpd-8) Color image stabilizer:
Mixture of compounds of the following formulae:
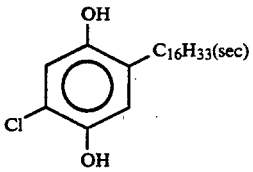
and
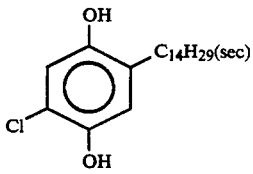
in a weight ratio of 1:1.
(Cpd-9) Color image stabilizer:
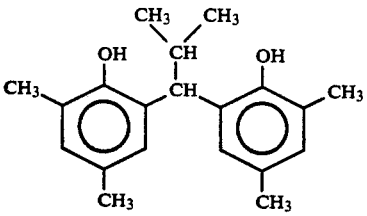
(Cpd-10) Antiseptic:
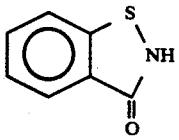
(Cpd-11) Antiseptic:
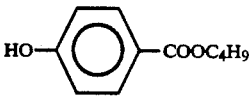

-continued
(UV-1) Ultraviolet ray-absorbing agent:
Mixture of compounds of the following formulae:
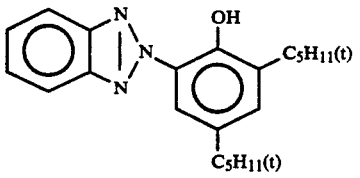
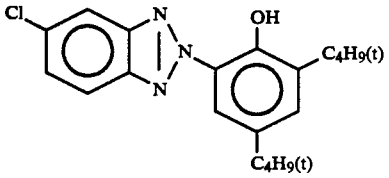
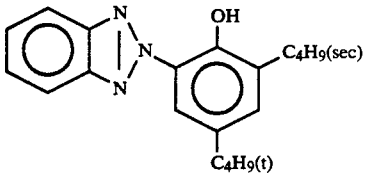
in a weight ratio of 4:2:4.
(Solv-1) Solvent:
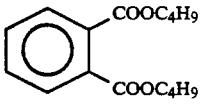
(Solv-2) Solvent:
Mixture of compounds of the following formulae:
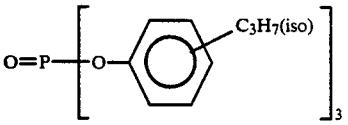
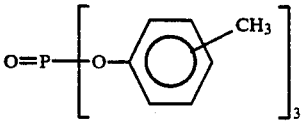
in a volume ratio of 1:1.
(Solv-3) Solvent:
$O{=}P{+}O{-}C_9H_{19}(iso)]_3$
(Solv-4) Solvent:
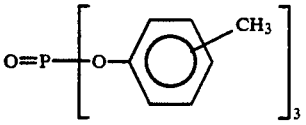
(Solv-5) Solvent:
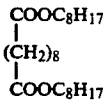
(Solv-6) Solvent:
Mixtures of compounds of the following formulae:

-continued

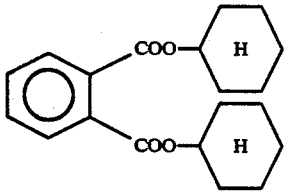

and $C_8H_{17}\underset{\diagdown O \diagup}{CHCH}(CH_2)_7COOC_8H_{17}$ in a volume ratio of 80:20.

(Solv-7) Solvent:

$C_8H_{17}\underset{\diagdown O \diagup}{CHCH}(CH_2)_7COOC_8H_{17}$

The sample prepared as described above was subjected to stepwise exposure through a trichromatic separation filter for sensitometry with a sensitometer (FWH of Fuji Photo Film Co., Ltd.; color temperature of the light source: 3200° K). The exposure conditions comprised 250 CMS and 0.1 sec.

The exposed sample was subjected to a running test with a paper processing machine and processing solutions described below by a process comprising the following steps until a color developer had been replenished in an amount of twice as much as the tank capacity.

| Step | Temp. | Time | Amount of replenisher* | Capacity of tank |
|---|---|---|---|---|
| Color development | 35° C. | 45 sec | 109 ml | 17 l |
| Bleaching-fixing | 30 to 35° C. | 45 sec | 215 ml | 17 l |
| Rinse (1) | 30 to 35° C. | 20 sec | — | 10 l |
| Rinse (2) | 30 to 35° C. | 20 sec | — | 10 l |
| Rinse (3) | 30 to 35° C. | 20 sec | 350 ml | 10 l |
| Drying | 70 to 80° C. | 60 sec | | |

*The amount of the replenisher was given per $m^2$ of the photosensitive material. (The rinses were used in countercurrent system from the rinse (3) to rinse (1).

The compositions of the processing solutions were as follows:

| | Mother* liquor | Replenisher |
|---|---|---|
| Color developer | | |
| Water | 800 ml | 800 ml |
| Ethylenediamine-N,N,N,N-tetramethylene-phosphonic acid | 1.5 g | 2.0 g |
| Potassium bromide | 0.015 g | — |
| Triethanolamine | 8.0 g | 12.0 g |
| Potassium chloride | 3.14 g | — |
| Potassium carbonate | 25 g | 25 g |
| N-Ethyl-N-β-methanesulfonamido-ethyl)-3-methyl-4-aminoaniline sulfate | 5.0 g | 11.5 g |
| Monosodium N,N-di(sulfoethyl) hydroxylamine | 5.5 g | 7.7 g |
| Fluorescent brightener (WHITEX 4B; mfd. by Sumitomo Chemical Co., Ltd.) | 1.0 g | 2.0 g |
| Water | ad 1000 ml | 1000 ml |
| pH (253° C.) | 10.05 | 10.45 |
| Bleach-fixing solution: (The mother liquor was the same as the replenisher) | | |

-continued

| | Mother* liquor | Replenisher |
|---|---|---|
| Water | 400 ml | |
| Ammonium thiosulfate (70%) | 100 ml | |
| Sodium sulfite | 17 g | |
| Ferric ammonium ethylenediaminetetra-acetate | 55 g | |
| Disodium ethylenediaminetetraacetate | 5 g | |
| Ammonium bromide | 40 g | |
| Water | ad 1000 ml | |
| pH (25° C.) | 6.0 | |

*Tank solution

Water for rinse (both mother liquor and replenisher)

Ion-exchanged water (containing not more than 3 ppm of calcium and magnesium)

Color developers were produced and subjected to the same continuous process as described above except that 4-amino-N-ethyl-N-β-methanesulfonamidoethyl-3-methylaniline (D-1) sulfate:

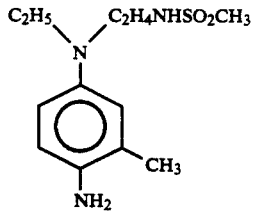

(D-1)

was replaced with an equimolar amount of a comparative color developing agent or a developing agent of the present invention given in Table 1.

The sample exposed as described above was process with the processing solutions thus subjected to the continuous process and then the maximum density ($D_{max}$) of a yellow image was determined.

Then the sample was exposed to xenon light (300,000 lux) for 20 days in order to examine reduction of the image density by the light irradiation and then the density change in a region of density of 2.0 was examined. The results are shown in Table 1.

COMPARATIVE EXAMPLE

D-2:

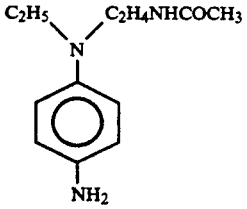

(compound of Example 1 in U.S. Pat. No. 2,592,363)

D-3:

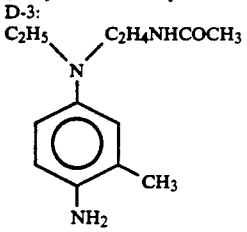

(compound of Example 2 in U.S. Pat. No. 2,592,363)

TABLE 1

| | Color developing agent | B, $D_{max}$ | Remaining optical density | Remarks |
|---|---|---|---|---|
| 1 | D-1 | 2.1 | 1.61 | Comp. Ex. |
| 2 | D-2 | 1.7 | 0.87 | " |
| 3 | D-3 | 2.0 | 1.54 | " |
| 4 | (2) | 2.1 | 1.70 | Present invention |
| 5 | (3) | 2.1 | 1.80 | " |
| 6 | (5) | 2.1 | 1.72 | " |
| 7 | (7) | 2.0 | 1.88 | " |
| 8 | (12) | 2.2 | 1.70 | " |
| 9 | (24) | 2.2 | 1.66 | " |
| 10 | (25) | 1.9 | 1.82 | " |
| 11 | (34) | 2.2 | 1.69 | " |
| 12 | (36) | 2.0 | 1.82 | " |
| 13 | (39) | 2.2 | 1.64 | " |
| 14 | (41) | 2.0 | 1.70 | " |
| 15 | (47) | 2.0 | 1.66 | " |
| 16 | (50) | 2.1 | 1.63 | " |
| 17 | (51) | 2.0 | 1.64 | " |
| 18 | (53) | 2.2 | 1.78 | " |
| 19 | (59) | 2.0 | 1.68 | " |
| 20 | (62) | 2.1 | 1.73 | " |
| 21 | (63) | 2.2 | 1.75 | " |

It is apparent from Table 1 that with any of the developing agents of the present invention, a yellow image density comparable to that obtained with the developing agent of each Comparative Example was obtained.

It is also apparent from Table 1 that the yellow image obtained with the developing agent of the present invention had an excellent light fastness.

EXAMPLE 2

Samples were prepared in the same manner as in Example 1 except that color developing agent of the present invention, (46), (47), (50), (51), (52), (53), (55), (59), (60), (62) or (63) was employed instead of the color developing agent of the present invention used in Example 1. The maximum density ($D_{max}$) of cyan image of the samples was measured.

Furthermore, in order to examine reduction of the density of the cyan image when it is stored, the sample was subjected to the conditions of 80° C. and 70% RH for 12 days and the residual density in a region of initial cyan density of 1.0. The results obtained are shown in Table 2.

TABLE 2

| | Color developing agent | R, $D_{max}$ | Remaining optical density | Remarks |
|---|---|---|---|---|
| 1 | D-1 | 2.60 | 0.82 | Comp. Ex. |
| 2 | D-2 | 2.05 | 0.42 | " |
| 3 | D-3 | 2.50 | 0.73 | " |
| 4 | (46) | 2.55 | 0.86 | Present invention |
| 5 | (47) | 2.65 | 0.88 | " |
| 6 | (50) | 2.60 | 0.88 | " |
| 7 | (51) | 2.60 | 0.85 | " |
| 8 | (52) | 2.60 | 0.88 | " |
| 9 | (53) | 2.65 | 0.90 | " |
| 10 | (55) | 2.55 | 0.84 | " |
| 11 | (59) | 2.60 | 0.85 | " |
| 12 | (60) | 2.60 | 0.95 | " |
| 13 | (62) | 2.65 | 0.89 | " |
| 14 | (63) | 2.65 | 0.90 | " |

It is apparent from Table 2 that with any of the developing agents of the present invention, a cyan image density comparable to that obtained with the developing agent of each Comparative Example was obtained.

It is also apparent from Table 2 that the cyan image obtained with the developing agent of the present invention had an excellent fastness to wet heat.

EXAMPLE 3

A silver halide color photographic photosensitive material produced in the same manner as that of a color photosensitive material (Sample No. 1 in Example 1 of J. P. KOKAI No. Hei 2-90145) was exposed to form an image and then continuously processed by the following method with an automatic developing machine until the total amount of the replenished solution had become three times as much as the volume of the tank.

| Step | Time | Temp. | Mother liquor Tank capacity | Replenisher |
|---|---|---|---|---|
| Color development | 135 sec | 38° C. | 11 l | 300 ml/m$^2$ |
| Bleach-fixing | 40 sec | 33° C. | 3 l | 300 ml/m$^2$ |
| Washing with water (1) | 40 sec | 33° C. | 3 l | — |
| Washing with water (2) | 40 sec | 33° C. | 3 l | 320 ml/m$^2$ |
| Drying | 30 sec | 80° C. | | |

Water for washing was supplied by counter current method wherein water was fed into the washing bath (2) and an overflow from the bath (2) was introduced into the washing bath (1). The amount of the bleach-fixing solution carried over from the bleach-fixing bath into the washing bath (1) by the photosensitive material was 35 ml/m$^2$ and the ratio of the replenished water to the bleach-fixing solution carried over was 9.1:1.

The compositions of the processing solutions were as follows:

| | Mother liquor | Replenisher |
|---|---|---|
| Color developer | | |
| D-Solbitol | 0.15 g | 0.20 g |
| Sodium naphthalenesulfonate/formalin condensate | 0.15 g | 0.20 g |
| Ethylenediaminetetrakismethylene-phosphonic acid | 1.5 g | 1.5 g |
| Diethylene glycol | 12.0 ml | 16.0 ml |

-continued

| | Mother liquor | Replenisher |
|---|---|---|
| Benzyl alcohol | 13.5 ml | 18.0 ml |
| Potassium bromide | 0.70 g | — |
| Benzotriazole | 0.003 g | 0.004 g |
| Sodium sulfite | 2.4 g | 3.2 g |
| N,N-bis(carboxymethyl)hydrazine | 4.0 g | 5.3 g |
| D-Glucose | 2.0 g | 2.4 g |
| Triethanolamine | 6.0 g | 8.0 g |
| N-Ethyl-N-(β-methanesulfonamidoethyl)-3-methyl-4-aminoaniline sulfate | 6.4 g | 8.5 g |
| Potassium carbonate | 30.0 g | 25.0 g |
| Fluorescent brightener (diaminostilbene compound) | 1.0 g | 1.2 g |
| Water | ad 1000 ml | 1000 ml |
| pH (25° C.) | 10.25 | 11.00 |
| Bleach-fixing solution: | | |
| Disodium ethylenediaminetetraacetate dihydrate | 2.0 g | (the same as the mother liquor) |
| Fe (III) ammonium ethylenediaminetetraacetate dihydrate | 70.0 g | |
| Ammonium thiosulfate (700 g/l) | 180 ml | |
| Sodium p-toluenesulfinate | 45.0 g | |
| Sodium bisulfite | 35.0 g | |
| 5-Mercapto-1,3,4-triazole | 0.5 g | |
| Ammonium nitrate | 10.0 g | |
| Water | ad 1000 ml | |
| pH (25° C.) | 6.10 | |

Water for washing (both mother liquor and replenisher)

City water was passed through a column of a mixed-bed system filled with H-type strong acidic cation exchange resin (Amberlite IR-120B; product of Rohm & Haas Co.) and OH-type anion exchange resin (Amberlite IR-400; product of Rohm & Haas Co.) to reduce calcium and magnesium ion concentration to 3 mg/l or less. Then 20 mg/l of sodium dichloroisocyanurate and 0.15 g/l of sodium sulfate were added thereto. The pH of the liquid was in the range of 6.5 to 7.5.

Then the same color developer as that described above was prepared and the same continuous process as above was repeated except that 4-amino-N-ethyl-N-β-methanesulfonamidoethyl-3-methylaniline sulfate was replaced with an equimolar amount of Compound (2), (4), (11), (33), (44), (46), (50), (53) and (59) of the present invention.

The sample exposed to form an image as described above was processed with the processing solutions described above. The yellow image had a superior light fastness to that obtained with that developing agent.

EXAMPLE 4

Samples were prepared in the same manner as in Example 3 except that equimolar amount of the color developing agent of the present invention, (47), (48), (51), (58) or (63) was employed instead of N-ethyl-N-β-methanesulfoneamidoethyl-3-methyl-4-aminoaniline sulfate contained in the color developer. As a result, with any of the developing agents of the present invention, the cyan image obtained with the developing agent of the present invention had an excellent fastness to wet heat, compared with that obtained with the comparative developing agent mentioned above.

EXAMPLE 5

A color photographic photosensitive material produced in the same manner as that of Sample 101 of Examples of J. P. KOKAI No. Hei 2-44345 was exposed and then process by the following method with an automatic developing machine until the total amount of the replenished solution had become three times as much as the volume of the tank.

TABLE 3

| Step | Processing steps: Time | Temp. | Replenisher | Tank capacity |
|---|---|---|---|---|
| Color development | 3 min 15 sec | 38° C. | 33 ml | 20 l |
| Bleaching | 6 min 30 sec | 38° C. | 25 ml | 40 l |
| Washing with water | 2 min 10 sec | 24° C. | 1200 ml | 20 l |
| Fixing | 4 min 20 sec | 38° C. | 25 ml | 30 l |
| Washing with water (1) | 1 min 05 sec | 24° C. | counter-current flow from (2) to (1) | 10 l |
| Washing with water (2) | 1 min 00 sec | 24° C. | 1200 ml | 10 l |
| Stabilization | 1 min 05 sec | 38° C. | 25 ml | 10 l |
| Drying | 4 min 20 sec | 55° C. | | |

The amount of the replenisher was given per 35 mm width and 1 m length.

The compositions of the processing solutions were as given below:

| | Mother liquor (g) | Replenisher (g) |
|---|---|---|
| (Color developer) | | |
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-β-hydroxyethylamino]-2-methylaniline sulfate | 4.5 | 5.5 |
| Water | ad 1.0 l | 1.0 l |
| pH | 10.05 | 10.10 |
| (Bleaching solution) | | |
| Sodium ferric ethylenediaminetetraacetate trihydrate | 100.0 | 120.0 |
| Disodium ethylenediaminetetraacetate | 10.0 | 10.0 |
| Ammonium bromide | 140.0 | 160.0 |
| Ammonium nitrate | 30.0 | 35.0 |
| Aqueous ammonia (27%) | 6.5 ml | 4.0 ml |
| Water | ad 1.0 l | 1.0 l |
| pH | 6.0 | 5.7 |
| (Fixing solution) | | |
| Disodium ethylenediaminetetraacetate | 0.5 | 0.7 |
| Sodium sulfite | 7.0 | 8.0 |
| Sodium hydrogensulfite | 5.0 | 5.5 |
| Aqueous ammonium thiosulfate (70%) | 170.0 ml | 200.0 ml |
| Water | ad 1.0 l | 1.0 l |
| pH | 6.7 | 6.6 |
| (Stabilizer) | | |
| Formalin (37%) | 2.0 ml | 3.0 ml |
| Polyoxyethylene-p-monononylphenyl ether (average degree of polymerization: 10) | 0.3 | 0.45 |
| Disodium ethylenediaminetetraacetate | 0.05 | 0.08 |
| Water | ad 1.0 l | 1.0 l |
| pH | 5.0–8.0 | 5.0–8.0 |

Then the same color developer as that described above was prepared and the same continuous process as above was repeated except that 4-amino-N-ethyl-N-β-hydroxyethyl-3-methylaniline sulfate was replaced with an equimolar amount of Compound (3), (5), (27), (38), (59) or (62) of the present invention.

The sample exposed to form an image as described above was processed with the processing solutions described above. The yellow image had a superior light fastness to that obtained with that developing agent.

Example 6

Samples were prepared in the same manner as in Example 5 except that equimolar amount of the color developing agent of the present invention, (50), (51) or (63) was employed instead of N-ethyl-N-β-hydroxyethyl-3-methyl-4-aminoaniline sulfate contained in the color developer. As a result, with any of the developing agents of the present invention, the cyan image obtained with the developing agent of the present invention had an excellent fastness to wet heat, compared with that obtained with the comparative developing agent mentioned above.

EXAMPLE 7

A color reversal photographic photosensitive material produced in the same manner as that of Sample No. 101 in Example 1 of J. P. KOKAI No. Hei 2-854 was exposed and then processed by the following method:

| Step | Time | Temp. | Tank capacity | Replenisher |
|---|---|---|---|---|
| The first development | 6 min | 38° C. | 12 l | 2200 ml/m$^2$ |
| The first washing with water | 2 min | 38° C. | 4 l | 7500 ml/m$^2$ |
| Reversal | 2 min | 38° C. | 4 l | 1100 ml/m$^2$ |
| Color development | 6 min | 38° C. | 12 l | 2200 ml/m$^2$ |
| Compensation | 2 min | 38° C. | 4 l | 1100 ml/m$^2$ |
| Bleaching | 6 min | 38° C. | 12 l | 220 ml/m$^2$ |
| Fixing | 4 min | 38° C. | 8 l | 1100 ml/m$^2$ |
| The second washing with water | 4 min | 38° C. | 8 l | 7500 ml/m$^2$ |
| Stabilization | 1 min | 25° C. | 2 l | 1100 ml/m$^2$ |

The compositions of the processing solutions were as follows:

| The first developer: | Mother liquor | Replenisher |
|---|---|---|
| Pentasodium nitrilo-N,N,N-trimethylenephosphonate | 2.0 g | 2.0 g |
| Sodium sulfite | 30 g | 30 g |
| Potassium hydroquinone monosulfonate | 20 g | 20 g |
| Potassium carbonate | 33 g | 33 g |
| 1-Phenyl-4-methyl-4-hydroxymethyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water | 1000 ml | 1000 ml |
| pH | 9.60 | 9.60 |

The pH was adjusted with hydrochloric acid or potassium hydroxide.

| Reversal solution: | Mother liquor | Replenisher |
|---|---|---|
| Pentasodium nitrilo-N,N,N-trimethylenephosphonate | 3.0 g | (the same as the mother liquor) |
| Stannous chloride dihydrate | 1.0 g | |
| p-Aminophenol | 0.1 g | |
| Sodium hydroxide | 8 g | |
| Glacial acetic acid | 15 ml | |
| Water | ad 1000 ml | |
| pH | 6.00 | |

The pH was adjusted with hydrochloric acid or sodium hydroxide.

| Color developer: | Mother liquor | Replenisher |
|---|---|---|
| Pentasodium nitrilo-N,N,N-trimethylenephosphonate | 2.0 g | 2.0 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-(β-methanesulfonamidoethyl)-3-methyl-4-aminoaniline sulfate | 11 g | 11 g |
| 3,6-Dithiaoctane-1,8-diol | 1.0 g | 1.0 g |
| Water | ad 1000 ml | 1000 ml |
| pH | 11.80 | 12.00 |

The pH was adjusted with hydrochloric acid or potassium hydroxide.

| Compensating solution: | Mother liquor | Replenisher |
|---|---|---|
| Disodium ethylenediaminetetraacetate dihydrate | 8.0 g | (the same as the mother liquor) |
| Sodium sulfite | 12 g | |
| 1-Thioglycerol | 0.4 ml | |
| Water | ad 1000 ml | |
| pH | 6.20 | |

The pH was adjusted with hydrochloric acid or sodium hydroxide.

| Bleaching solution: | Mother liquor | Replenisher |
|---|---|---|
| Disodium ethylenediaminetetraacetate dihydrate | 2.0 g | 4.0 g |
| Fe(III) ammonium ethylenediaminetetraacetate dihydrate | 120 g | 240 g |
| Potassium bromide | 100 g | 200 g |
| Ammonium nitrate | 10 g | 20 g |
| Water | ad 1000 ml | 1000 ml |
| pH | 5.70 | 5.50 |

The pH was adjusted with hydrochloric acid or sodium hydroxide.

| Fixing solution: | Mother liquor | Replenisher |
|---|---|---|
| Ammonium thiosulfate | 8.0 g | (the same as the mother liquor) |
| Sodium sulfite | 5.0 g | |
| Sodium hydrogensulfite | 5.0 g | |
| Water | ad 1000 ml | |
| pH | 6.60 | |

The pH was adjusted with hydrochloric acid or aqueous ammonia.

| Stabilizer: | Mother liquor | Replenisher |
|---|---|---|
| Formalin (37%) | 5.0 ml | (the same as the mother |
| Polyoxyethylene-p-monononyl phenyl ether (average degree of polymeriza- | 0.5 ml | |

-continued

| Stabilizer: | Mother liquor | Replenisher |
|---|---|---|
| tion: 10) | | liquor) |
| Water | ad 1000 ml | |
| pH | not adjusted | |

Then color developers were prepared in the same manner as that described above except that 4-amino-N-ethyl-N-β-methanesulfonamidoethyl-3-methylaniline sulfate in the color developer was replaced with an equimolar amount of Compound (2), (3), (5), (12), (28), (42), (46), (53), (55), (59) or (62) of the present invention to obtain a preferred yellow image having an excellent fastness to light.

It is apparent from the Examples that the color developing agent of the present invention has ordinary excellent photographic properties and is capable of forming an image of a colored dye (for example, yellow) having an excellent fastness to light.

EXAMPLE 8

Samples were prepared in the same manner as in Example 7 except that equimolar amount of the color developing agent of the present invention, (50), (52), (53), (59) or (63) was employed instead of N-ethyl-N-β-methanesulfoneamidoethyl-3-methyl-4-aminoaniline sulfate contained in the color developer. As a result, with any of the developing agents of the present invention, the cyan image obtained with the developing agent of the present invention had an excellent fastness to wet heat, compared with that obtained with the comparative developing agent mentioned above.

What is claimed is:

1. A p-phenylenediamine compound for use as a color developing agent wherein one of the amino groups is a primary amino group and the other is a tertiary amino group substituted with a group of the following general formula [I]:

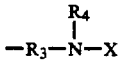

wherein $R_3$ represents an alkylene group wherein the main chain has at least 2 carbon atoms, $R_4$ represents a hydrogen atom or an alkyl group, and X represents a group selected from among:

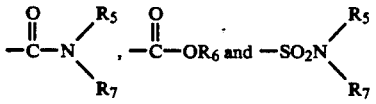

in which $R_5$ and $R_7$ may be the same or different from each other, each represent a hydrogen atom, an alkyl group or an aryl group and may form a heterocyclic ring by the combination thereof, and $R_6$ represents an alkyl group or an aryl group.

2. The p-phenylenediamine compound of claim 1 wherein the developing agent is represented by the following formula [II]:

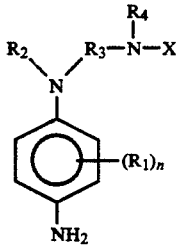

[II]

wherein $R_1$ represents a substituent, n represents an integer of 0 to 4 and when n is 2 or more, $R_1$'s may be the same or different from each other, $R_2$ represents an alkyl group, $R_3$ represents an alkylene group wherein the main chain has at least 2 carbon atoms, $R_4$ represents a hydrogen atom or an alkyl group, and X represents a group selected from among:

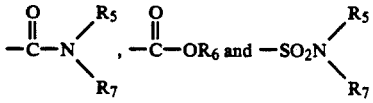

in which $R_5$ and $R_7$ may be the same or different from each other and each represent a hydrogen atom, an alkyl group or an aryl group and $R_6$ represents an alkyl group or an aryl group.

3. The p-phenylenediamine compound of claim 2 wherein $R_1$ represents a halogen atom or an alkyl group, aryl group, heterocyclic group, cyano group, nitro group, hydroxyl group, carboxyl group, alkoxyl group, aryloxy group, acylamino group, alkylamino group, anilino group, ureido group, sulfamoylamino group, alkylthio group, arylthio group, alkoxycarbonylamino group, sulfonamide group, carbamoyl group, sulfamoyl group, sulfonyl group, alkoxycarbonyl group, heterocyclic oxy group, azo group, acyloxy group, carbamoyloxy group, silyl group, silyloxy group, aryloxycarbonylamino group, imide group, heterocyclic thio group, sulfinyl group, sulfonyl group, aryloxycarbonyl group or acyl group, $R_2$ represents an alkyl group having 1 to 16 carbon atoms, $R_3$ represents an alkylene group having 2 to 5 carbon atoms, $R_4$ represents a hydrogen atom or an alkyl group having 1 to 16 carbon atoms, $R_5$ and $R_7$ represent a hydrogen atom, an alkyl group having 1 to 16 carbon atoms or an aryl group having 6 to 24 carbon atoms, and $R_6$ represents an alkyl group having 1 to 16 carbon atoms or an aryl group having 6 to 24 carbon atoms.

4. The p-phenylenediamine compound of claim 3 wherein $R_1$ represents a halogen atom or an alkyl group having 1 to 16 carbon atoms, aryl group having 6 to 24 carbon atoms, heterocyclic group of 5 or 6 membered ring having at least one atom selected from the group consisting of oxygen, nitrogen and sulfur, cyano group, nitro group, hydroxyl group, carboxyl group, alkoxyl group having 1 to 16 carbon atoms, aryloxy group having 6 to 24 carbon atoms, acylamino group having 1 to 16 carbon atoms, alkylamino group having 1 to 16 carbon atoms, anilino group having 6 to 24 carbon atoms, ureido group having 1 to 16 carbon atoms, sulfamoylamino group having 0 to 16 carbon atoms, alkylthio group having 1 to 16 carbon atoms, arylthio group having 6 to 24 carbon atoms, alkoxycarbonylamino group having 2 to 16 carbon atoms, sulfonamide group having 1 to 16 carbon atoms, carbamoyl group having 1 to 16 carbon atoms, sulfamoyl group having 0 to 16 carbon atoms, sulfonyl group having 1 to 16 carbon atoms, alkoxycarbonyl group having 1 to 16 carbon atoms, heterocyclic oxy group of 5 or 6 membered ring having at least one atom selected from the group consisting of oxygen, nitrogen and sulfur, azo group having 1 to 16 carbon atoms, acyloxy group having 1 to 16 carbon atoms, carbamoyloxy group having 1 to 16 carbon atoms, silyl group 3 to 16 carbon atoms, silyloxy group 3 to 16 carbon atoms, aryloxycarbonylamino group 7 to 24 carbon atoms, imide group 4 to 16 carbon atoms, heterocyclic thio group of 5 or 6 membered ring having at least one atom selected from the group consisting of oxygen, nitrogen and sulfur, sulfinyl group 1 to 16 carbon atoms, phosphonyl group 2 to 16 carbon atoms, aryloxycarbonyl group 7 to 24 carbon atoms or acyl group 1 to 16 carbon atoms.

5. The p-phenylenediamine compound of claim 4 wherein $R_1$ represents an alkyl group, alkoxyl group, alkoxycarbonylamino group or ureido group.

6. The p-phenylenediamine compound of claim 5 wherein $R_1$ represents an alkyl group, $R_2$ represents an alkyl group having 1 to 5 carbon atoms, $R_3$ represents an alkylene group having 2 to 4 carbon atoms, $R_4$ represents a hydrogen atom, $R_5$ represents a hydrogen atom, $R_7$ represents an alkyl group having 1 to 2 carbon atoms and X represents a group of the formula:

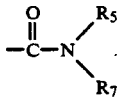

7. The p-phenylenediamine compound of claim 2 wherein the developing agent is represented by the following formula [III]:

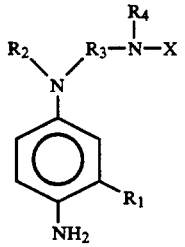

[III]

wherein $R_1$, $R_2$, $R_3$, $R_4$ and X are as defined above.

8. The p-phenylenediamine compound of claim 7 wherein $R_1$ represents an alkyl group having 1 to 16 carbon atoms, alkoxyl group having 1 to 16 carbon atoms, alkoxycarbonylamino group having 2 to 16 carbon atoms or ureido group having 1 to 16 carbon atoms.

9. The p-phenylenediamine compound of claim 8 wherein $R_1$ represents an alkyl group, $R_2$ represents an alkyl group having 1 to 5 carbon atoms, $R_3$ represents an alkylene group having 2 to 3 carbon atoms, $R_4$ represents a hydrogen atom, $R_5$ represents a hydrogen atom, $R_7$ represents an alkyl group having 1 to 2 carbon atoms and X represents a group of the formula:

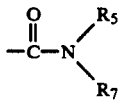

10. A processing liquid composition for a silver halide color photosensitive material, which comprises a p-phenylenediamine color developing agent wherein one of the amino groups is a primary amino group and the other is a tertiary amino group substituted with a group of the following general formula [I]:

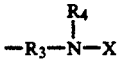

wherein $R_3$ represents an alkylene group wherein the main chain has at least 2 carbon atoms, $R_4$ represents a hydrogen atom or an alkyl group, and X represents a group selected from among:

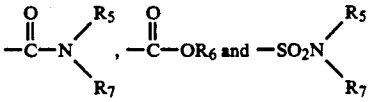

in which $R_5$ and $R_7$ may the same or different from each other, each represent a hydrogen atom, an alkyl group or an aryl group and may form a heterocyclic ring by the combination thereof, and $R_6$ represents an alkyl group or an aryl group and a balance of water.

11. A processing liquid composition of claim 10 wherein the developing agent is represented by the following formula [II]:

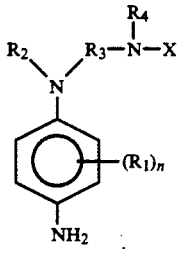

[II]

wherein $R_1$ represents a substituent, n represents an integer of 0 to 4 and when n is 2 or more, $R_1$'s may be the same or different from each other, $R_2$ represents an alkyl group, $R_3$ represents an alkylene group wherein the main chain has at least 2 carbon atoms, $R_4$ represents a hydrogen atom or an alkyl group, and X represents a group selected from among:

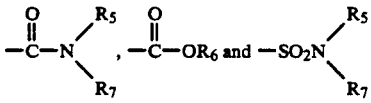

in which $R_5$ and $R_7$ may be the same or different from each other and each represent a hydrogen atom, an alkyl group or an aryl group and $R_6$ represents an alkyl group or an aryl group.

12. A processing liquid composition of claim 11 wherein $R_1$ represents an alkyl group having 1 to 16 carbon atoms, alkoxyl group having 1 to 16 carbon atoms, alkoxycarbonylamino group having 2 to 16 carbon atoms or ureido group having 1 to 16 carbon atoms.

13. A processing liquid composition of claim 12 wherein $R_1$ represents an alkyl group, $R_2$ represents an alkyl group having 1 to 5 carbon atoms, $R_3$ represents an alkylene group having 2 to 4 carbon atoms, $R_4$ represents a hydrogen atom, $R_5$ represents a hydrogen atom, $R_7$ represents an alkyl group having 1 to 2 carbon atoms and X represents a group of the formula:

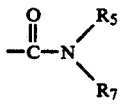

14. A processing liquid composition of claim 10 wherein the liquid comprises a pH buffering agent and has a pH of 9 to 12.

15. A process for forming a color image which comprises color-developing an image-wise exposed silver halide color photographic material with a processing liquid composition comprising a p-phenylenediamine color developing agent wherein one of the amino groups is a primary amino group and the other is a tertiary amino group substituted with a group of the following general formula [I]:

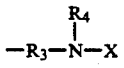

wherein $R_3$ represents an alkylene group wherein the main chain has 5 at least 2 carbon atoms, $R_4$ represents a hydrogen atom or an alkyl group, and X represents a group selected from among:

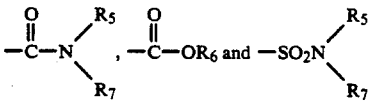

in which $R_5$ and $R_7$ may be the same or different from each other, each represent a hydrogen atom, an alkyl group or an aryl group and may form a heterocyclic ring by the combination thereof, and $R_6$ represents an alkyl group or an aryl group, and a balance of water.

16. A process for forming a color image of claim 15 wherein the developing agent is represented by the following formula [II]:

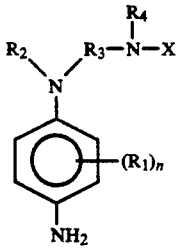

[II]

wherein $R_1$ represents a substituent, n represents an integer of 0 to 4 and when n is 2 or more, $R_1$'s may be the same or different from each other, $R_2$ represents an alkyl group, $R_3$ represents an alkylene group wherein the main chain has at least 2 carbon atoms, $R_4$ represents a hydrogen atom or an alkyl group, and X represents a group selected from among:

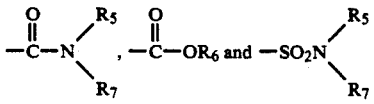

in which $R_5$ and $R_7$ may be the same or different from each other and each represent a hydrogen atom, an alkyl group or an aryl group and $R_6$ represents an alkyl group or an aryl group.

17. A process for forming a color image of claim 16 wherein $R_1$ represents an alkyl group having 1 to 16 carbon atoms, alkoxyl group having 1 to 16 carbon atoms, alkoxycarbonylamino group having 2 to 16 carbon atoms or ureido group having 1 to 16 carbon atoms.

18. A process for forming a color image of claim 17 wherein $R_1$ represents an alkyl group, $R_2$ represents an alkyl group having 1 to 5 carbon atoms, $R_3$ represents an alkylene group having 2 to 4 carbon atoms, $R_4$ represents a hydrogen atom, $R_5$ represents a hydrogen atom, $R_7$ represents an alkyl group having 1 to 2 carbon atoms and X represents a group of the formula:

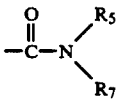

19. A process for forming a color image of claim 15 wherein the liquid comprises a PH buffering agent and has a pH of 9 to 12.

20. A process for forming a color image of claim 15 wherein the image-wise exposed silver halide color photographic material is color-developed with the processing liquid composition comprising a pH buffering agent and having a pH of 9 to 12 at a temperature of 30° to 45° C. for 20 seconds to 4 minutes.

* * * * *